US008265927B2

(12) United States Patent
Isobe et al.

(10) Patent No.: US 8,265,927 B2
(45) Date of Patent: Sep. 11, 2012

(54) COMMUNICATION SYSTEM FOR BUILDING SPEECH DATABASE FOR SPEECH SYNTHESIS, RELAY DEVICE THEREFOR, AND RELAY METHOD THEREFOR

(75) Inventors: Shin-ichi Isobe, Yokosuka (JP); Takuji Sakaguchi, Yokohama (JP); Motoshi Tamura, Zushi (JP); Masami Yabusaki, Kashiwa (JP)

(73) Assignee: NTT DoCoMo, Inc., Tokyo (JP)

( * ) Notice: Subject to any disclaimer, the term of this patent is extended or adjusted under 35 U.S.C. 154(b) by 795 days.

(21) Appl. No.: 12/389,062

(22) Filed: Feb. 19, 2009

(65) Prior Publication Data

US 2009/0210221 A1 Aug. 20, 2009

(30) Foreign Application Priority Data

Feb. 20, 2008 (JP) ..... 2008-039321

(51) Int. Cl.
*G10L 21/02* (2006.01)

(52) U.S. Cl. ..... 704/226; 704/231; 704/243

(58) Field of Classification Search ..... 704/258, 704/259, 260, 266, 270, 270.1, 226, 200, 704/231, 235, 244, 250, 243; 455/416; 379/88.17
See application file for complete search history.

(56) References Cited

U.S. PATENT DOCUMENTS

| | | | | |
|---|---|---|---|---|
| 6,795,534 | B2 * | 9/2004 | Noguchi | 379/88.17 |
| 7,003,286 | B2 * | 2/2006 | Brown et al. | 455/416 |
| 7,143,038 | B2 * | 11/2006 | Katae | 704/258 |
| 8,055,501 | B2 * | 11/2011 | Kuo et al. | 704/258 |
| 2003/0088419 | A1 | 5/2003 | Fukuzato | |

FOREIGN PATENT DOCUMENTS

| | | | |
|---|---|---|---|
| JP | 2003-140674 | A | 5/2003 |
| JP | 2003-141116 | A | 5/2003 |
| JP | 2003-152891 | A | 5/2003 |
| JP | 2003-295880 | A | 10/2003 |

OTHER PUBLICATIONS

Office Action from counterpart Korean Application No. 10-2009-0013442, dated Oct. 29, 2010, 7 pages (with translation).

* cited by examiner

*Primary Examiner* — Huyen X. Vo
(74) *Attorney, Agent, or Firm* — Brinks Hofer Gilson & Lione

(57) ABSTRACT

A relay device 20 duplicates speech data received from a communication terminal that is engaged in voice communication with another communication terminal. The duplicated speech data is transmitted to and is stored at a media processing device 40. Media processing device 40 builds a database for speech synthesis based on the stored speech data.

23 Claims, 13 Drawing Sheets

FIG. 4

204

| CALLER COMMUNICATION TERMINAL IDENTIFIER | CALLER COMMUNICATION TERMINAL IP ADDRESS | RECEIVER COMMUNICATION TERMINAL IDENTIFIER | RECEIVER COMMUNICATION TERMINAL IP ADDRESS | SPEECH SYNTHESIS (CALLER) | SPEECH SYNTHESIS (RECEIVER) |
|---|---|---|---|---|---|
| 090AAAAAAAA | 169.168.1.2 | 090BBBBBBBB | 169.168.1.3 | YES | YES |
| 090CCCCCCCC | 169.168.1.4 | 090DDDDDDDD | 169.168.1.5 | NO | NO |
| 090EEEEEEEE | 169.168.1.6 | 090FFFFFFFF | 169.168.1.7 | NO | YES |
| | | | | | |

FIG. 5

PROFILE INFORMATION

| USER ID | PHONE NUMBER | SPEECH SYNTHESIS SERVICE SUBSCRIPTION | REGISTRATION STATE |
|---|---|---|---|
| A | 090-AAAA-AAAA | YES | RELAY DEVICE 20a |
| B | 090-BBBB-BBBB | YES | RELAY DEVICE 20b |
| C | 090-CCCC-CCCC | NO | -- |
| D | 090-DDDD-DDDD | YES | RELAY DEVICE 20b |
| | | | |

301

COMMUNICATION SYSTEM FOR BUILDING SPEECH DATABASE FOR SPEECH SYNTHESIS, RELAY DEVICE THEREFOR, AND RELAY METHOD THEREFOR

RELATED APPLICATIONS

This application claims priority under 35 U.S.C. §119 to Japanese Patent Application No. JP2008-039321 filed on Feb. 20, 2008, the entire content of which is hereby incorporated by reference.

BACKGROUND

1. Field of the Invention

The present invention relates to a communication system for building speech databases for use in speech synthesis, to a relay device therefor, and to a relay method therefor. In particular, the present invention relates to a communication system for building, based on spoken dialogue in telephone and videophone calls, a speech database for use in speech synthesis that focuses on the reproduction of individual characteristics, to a relay device therefor, and to a relay method therefor.

2. Description of Related Art

Speech synthesis technology has been developed with a focus on the naturalness of synthesized speech and individuality so that it is likely that the synthesized speech will be similar to the speech of a human subject.

In such speech synthesis technology, pieces of speech data for a human subject are registered in advance in a database, which was created by recording different pieces of speech of the human subject by causing the human subject to read aloud different stories, and pieces that best match input texts are combined to produce synthesized speech, for example, as described in Japanese Patent Application Laid-Open Publication No. 2003-295880.

However, in the conventional speech synthesis technology, it usually takes many hours of recoding (for example, several to several tens of hours) at a dedicated studio to build a database in which many pieces of speech data for speech synthesis are stored. Therefore, conventional systems can be used for systems that require only limited types of speech patterns, such as a car navigation system or an IVR (Interactive Voice Response) system, but were not suited to reproducing the speech of the human subject in a system such as a mobile communication system.

SUMMARY OF THE INVENTION

The present invention has been conceived in view of the above problems and has as an object to provide a communication system for building a speech database for speech synthesis, the system focusing on individuality in reproducing the characteristics of the speech of the human subject, and also to provide a relay device therefor, and a relay method therefor.

In one aspect, the present invention provides a communication system having a relay device connected to a communication network; at least two communication terminals connected to the communication network via the relay device, each communication terminal transmitting to, and receiving speech data from, another communication terminal via the relay device; and a media processing device connected to the relay device, and the relay device has a transmitter-receiver that receives first speech data originating from a first communication terminal and that transmits the received first speech data to a second communication terminal; a data duplicator that duplicates speech data; and a communication controller that causes the data duplicator to duplicate the first speech data received from the first communication terminal via the transmitter-receiver and that causes the transmitter-receiver to transmit the duplicated speech data to the media processing device, and the media processing device has a receiver that receives, from the relay device, the duplicated speech data of the first communication terminal; a speech data processor that stores speech data received by the receiver in a speech data storage device; a speech synthesis database generator that generates a speech synthesis database for the first communication terminal based on the speech data stored in the speech data storage device; a speech synthesis database storage device that stores a speech synthesis database generated by the speech synthesis database generator; and a speech synthesizer that executes speech synthesis based on the speech synthesis database in a case in which a request for the speech synthesis is received from the first communication terminal. According to the communication system of the present invention, it is possible to easily build a speech synthesis database in which emphasis is placed on the individuality of reproducing speech characteristics of a human subject.

In a preferred embodiment, in the communication system, the relay device may further have a communication information storage device that stores communication information on the first and the second communication terminals, the communication information at least including service information indicating whether the first communication terminal subscribes to a speech synthesis service, and the communication controller may determine that the speech data received by the transmitter-receiver is to be duplicated in a case in which the service information indicates that the first communication terminal subscribes to the speech synthesis service and causes the duplicator to duplicate the speech data. According to this mode, speech data transmitted from a communication terminal is duplicated and transmitted to the media processing device only in a case in which the communication terminal subscribes to the speech synthesis service. Therefore, compared to a case in which all incoming pieces of speech data are duplicated, the processing load is reduced on the relay device of duplicating and transmitting the duplicated pieces of speech data. Also, the communication resources of the communication system can be conserved. Therefore, the efficiency in building a database for speech synthesis is increased.

Preferably, the communication system may further have a subscription information database device that is connected to the relay device and for storing the subscription information on each of the at least two communication terminals (or subscription information for all terminals that are contracted to an operator of the network), and the communication information on the first communication terminal stored in the communication information storage device may be created based on information downloaded from the subscription information database device. According to this mode, since service information on the first communication terminal can be downloaded from the subscription information database, the relay device does not have to store the service information for communication terminals that are not currently engaged in communication via this relay device. Therefore, the memory consumption on the relay device is reduced.

More preferably, the transmitter-receiver of the relay device may further receive speech data from the second communication terminal and may transmit the received speech data to the first communication terminal, and the communication controller may cause the data duplicator to duplicate the speech data received from the second communication terminal via the transmitter-receiver in a case in which the number of calls performed between the first and the second communication terminals in a certain period exceeds a threshold. According to this mode, a database for a correspondent communication terminal can also be built even in a case in which the correspondent communication terminal does not subscribe to the speech synthesis service.

In another preferred embodiment of the communication system, the communication controller may cause the data duplicator to duplicate the speech data received from the first communication terminal via the transmitter-receiver in a case in which the transmitter-receiver receives an instruction for the duplication from the first communication terminal. In this case, the first communication terminal may indicate speech data to be recorded every time speech data is transmitted. Alternatively, the first communication terminal may indicate whether to record the speech data after the voice communication is terminated. According to this mode, speech data to be recorded in the media processing device can be freely indicated by a communication terminal.

In still another preferred embodiment of the communication system, the speech data processor may further have a determiner that determines whether the piece of speech data received by the receiver corresponds to any piece of the stored speech data and a noise measurer that measures the amount of noise contained in the received piece of speech data and the amount of noise contained in the corresponding piece of stored speech data, and the speech data processor may overwrite the stored piece of speech data with the received piece of speech data in a case in which the amount of noise of the received piece of speech data is less than that of the corresponding piece of stored speech data. In still yet another preferred embodiment, the speech data processor may further have a noise filter that removes background noise contained in the speech data, and the speech data processor may store the speech data after the noise is removed by the noise filter. In these cases, a speech synthesis database can provide higher quality speech data.

In a preferred embodiment, the transmitter-receiver of the relay device may further receive second speech data originating from the second communication terminal and may transmit the received second speech data to the first communication terminal; and the communication controller may cause the data duplicator to duplicate at least one of the first and the second pieces of speech data and may cause the transmitter-receiver to transmit, to the media processing device, the duplicated piece of speech data together with identification information identifying one of the first and the second communication terminals as the originating communication terminal, and the receiver of the media processing device may receive, from the relay device, the duplicated piece of speech data and the identification information; the speech data processor may store the piece of speech data received by the receiver by the identification information in the speech data storage device; and the speech synthesis database generator may generate a speech synthesis database for the originating communication terminal based on the speech data stored in the speech data storage device; and the speech synthesizer may execute speech synthesis based on the speech synthesis database in a case in which a request for the speech synthesis is received from a communication terminal identified by the identification information. In this case, both the first and the second communication terminals may be connected to the same relay device of the communication system of the present invention. Alternatively, the first communication terminal may be connected to the relay device of the present invention, and the second communication terminal may be connected to any other relay device, including the relay device of the present invention. According to this embodiment, speech data of at least one of the first and the second communication terminals can be recorded.

Preferably, the relay device may further have a communication information storage device that stores communication information on the first and the second communication terminals, the communication information at least including service information for each of the first and second communication terminals, with the service information indicating whether each of the first and second communication terminals subscribes to a speech synthesis service, and the communication controller may determine that the first speech data received by the transmitter-receiver is to be duplicated in a case in which the service information indicates that the first communication terminal subscribes to the speech synthesis service and may cause the duplicator to duplicate the first speech data and may also determine that the second speech data received by the transmitter-receiver is to be duplicated in a case in which the service information indicates that the second communication terminal subscribes to the speech synthesis service and may cause the duplicator to duplicate the second speech data. In this case, since the determination is performed for each of the first and the second communication terminals as to whether each terminal subscribes to the speech synthesis service, the first speech data and the second speech data each are duplicated only in a case in which the originating communication terminal subscribes to the speech synthesis service. Thus, the efficiency in building a database for speech synthesis is increased.

More preferably, the communication system may further have a subscription information database device that is connected to the relay device and for storing subscription information on each of the at least two plural terminals (or subscription information for all terminals that are contracted to the network operator), and the relay device may further have a first downloader that downloads, from the subscription information database device, service information on the first communication terminal, for storage into the communication information storage device and a second downloader that downloads, from the subscription information database device, service information on the second communication terminal, for storage into the communication information storage device. According to this mode, since service information on both the first and the second communication terminals can be downloaded from the subscription information database, the relay device does not have to store the service information for communication terminals that are not currently communicated via this relay device. Therefore, the processing load on the relay device is reduced.

In this case, the communication system may have a plurality of the relay devices, including a first relay device connecting to the first communication terminal and having the first downloader and a second relay device connecting to the second communication terminal and having the second downloader; and the second relay device may further have a transferer that transfers the service information on the second communication terminal to the first relay device, and the first relay device may store the service information on the first communication terminal downloaded by the first downloader and the service information on the second communication terminal transmitted from the second relay device in the communication information storage device. According to this mode, since service information is downloaded by each of the first and the second relay devices and service information that is downloaded by the second relay device is transferred to the first relay device, the first relay device can perform the determination for each of the first and the second speech data as to whether the speech data should be duplicated.

In another aspect, the present invention provides a relay device for use in a communication system including the relay device connected to a communication network and at least two communication terminals connected to the communication network via the relay device and for relaying data from a communication terminal to another communication terminal, and the relay device may have a transmitter-receiver that receives speech data from a first communication terminal and transmits the received speech data to a second communication terminal; a data duplicator that duplicates speech data; and a communication controller that causes the data duplicator to duplicate the speech data received from the first communication terminal via the transmitter-receiver and that causes the transmitter-receiver to transmit the duplicated speech data to a media processing device for storing the duplicated speech data and generating a speech synthesis database. According to the relay device of the present invention, it is possible to easily configure a speech synthesis database in which emphasis is placed on the individuality of reproducing speech characteristics of a human subject.

In still another aspect, the present invention provides a relay method for use at a relay device in a communication system including the relay device connected to a communication network and at least two communication terminals connected to the communication network via the relay device, with the relay device relaying data from a communication terminal to another communication terminal, and the method may include receiving speech data from a first communication terminal and transmitting the received speech data to a second communication terminal; duplicating the speech data received in the receiving step; and transmitting the duplicated speech data to a media processing device for storing the duplicated speech data and generating a speech synthesis database. According to the relay method of the present invention, it is possible to easily configure a speech synthesis database in which emphasis is placed on the individuality of reproducing speech characteristics of a human subject.

According to the present invention, a communication system for easily building a speech database for speech synthesis, the system focusing on the individuality of reproducing the characteristics of the speech of a human subject, and also a relay device therefor, and a relay method therefor can be provided.

BRIEF DESCRIPTION OF THE DRAWINGS

FIG. 4 is a table showing examples of data stored in a communication information storage device in the relay device.

FIG. 5 is a table showing examples of data stored in a registration information database according to the embodiment.

DETAILED DESCRIPTION OF THE PREFERRED EMBODIMENTS

In the following, detailed description will be given of a preferred embodiment of the present invention with reference to the drawings.

Figure 1:
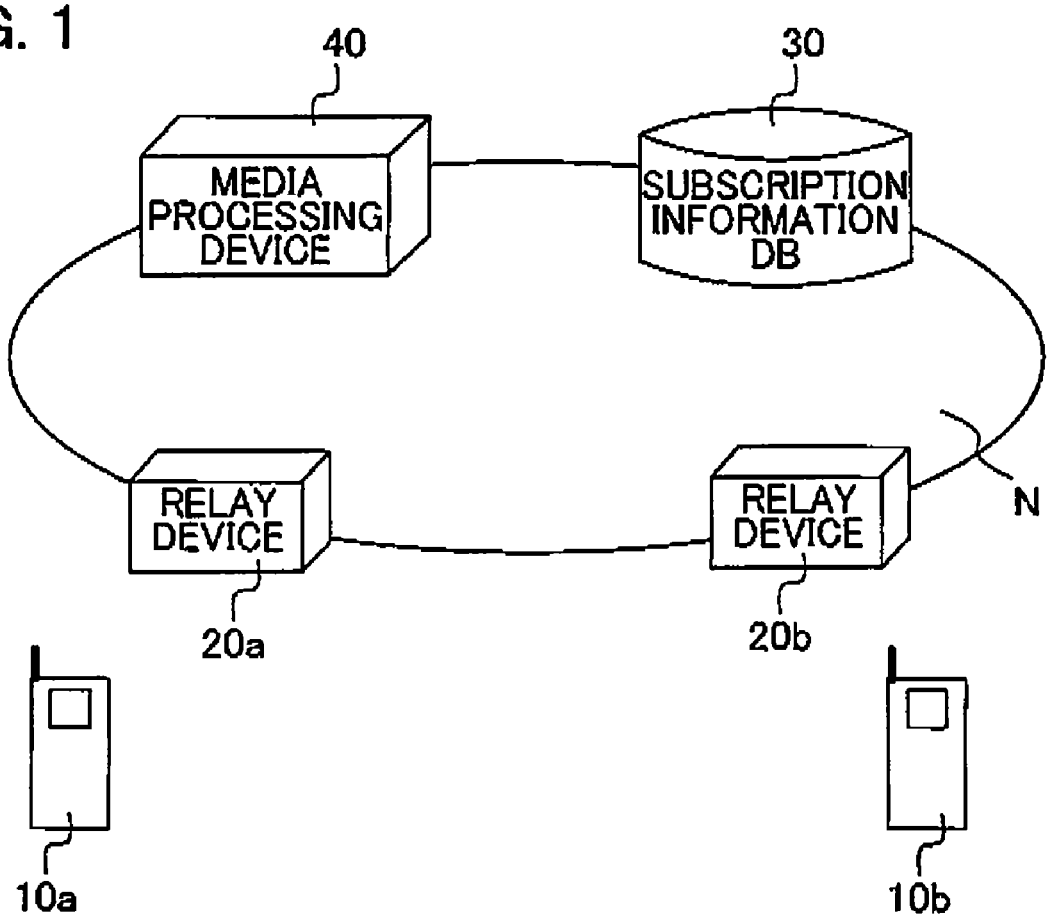
FIG. 1 is a diagram showing an overall configuration of a communication system according to an embodiment of the present invention.

FIG. 1 shows an example of a communication system for building a speech database for use in speech synthesis according to the present embodiment. The communication system has plural communication terminals 10 (communication terminals 10*a*,10*b*) served by a network N, plural relay devices 20 (relay devices 20*a*,20*b*) for connecting respective communication terminals to network N, a subscription information DB (database) 30 for managing subscription information of each communication terminal 10, and a media processing device 40 for storing and processing media information relating to each communication terminal, and these devices are connected to one another via network N. Three or more communication terminals 10 or relay devices 20 may be provided, although only two communication terminals 10 and two relay devices 20 are shown in the figure.

Speech data includes, for example, speech data of voice communication, videophones, and answering machines. Media information is, for example, video and audio messages, music files, and animation recorded for example by answering machines.

Communication terminal 10 is connected to network N via relay device 20. Network N provides a communication service to each communication terminal 10 and is, for example, a mobile communication network. Communication terminal 10 is connected to relay device 20 by wire or by wireless. Communication terminal 10 is capable of communicating, via relay device 20, with another communication terminal 10 that is also connected to network N. Communication terminal 10 is a computer having a CPU (Central Processing Unit), a RAM (Random Access Memory), and a ROM (Read Only Memory) as primary storage devices, a communication module for performing communication, hardware such as a hard disk as an auxiliary storage device, and an operation unit operated by a user of communication terminal 10 (not shown). These elements operate in cooperation with one another, whereby the functions of communication terminal 10 as described in the following are realized.

Figure 2:
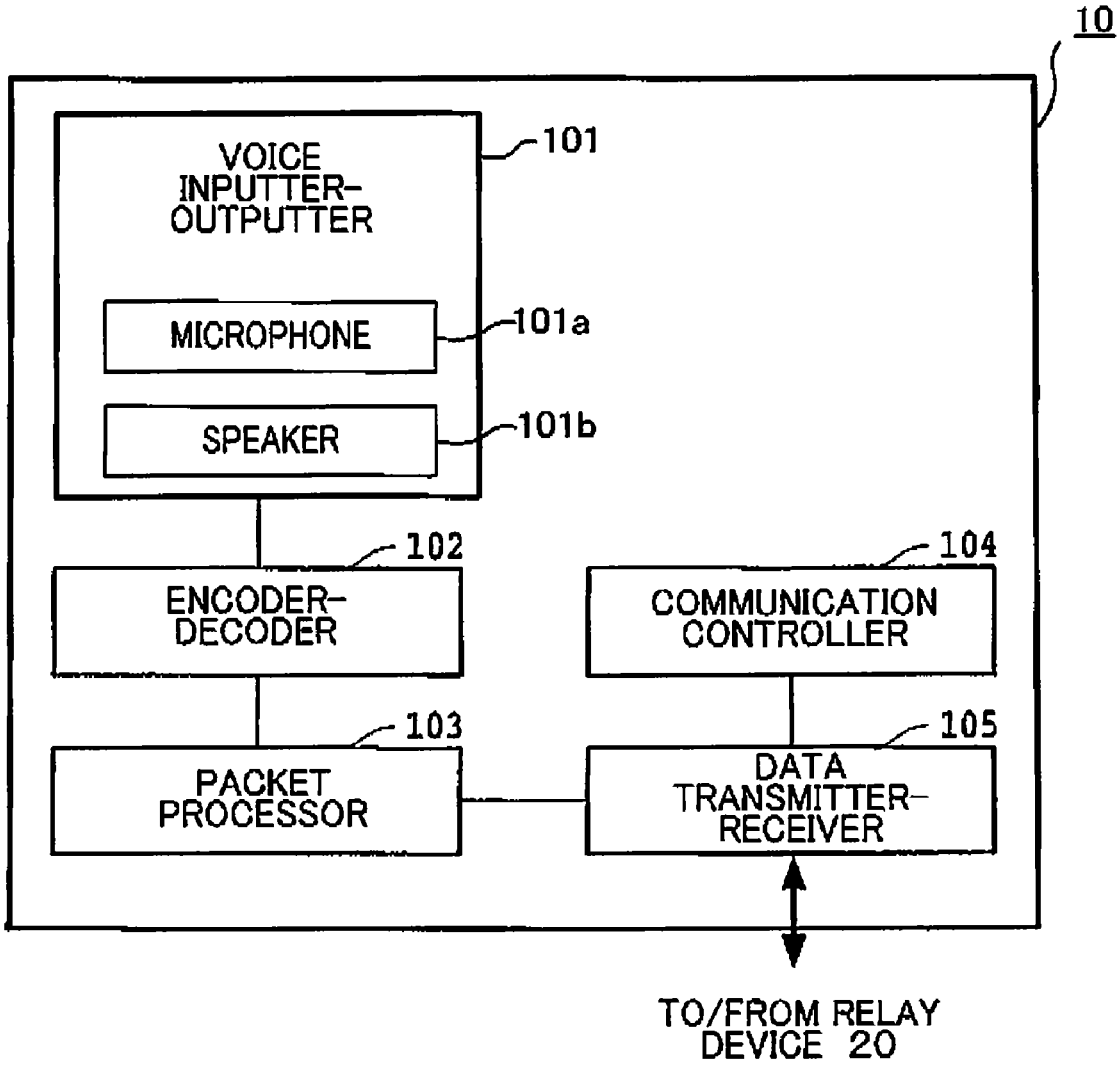
FIG. 2 is a block diagram showing a functional configuration of a communication terminal according to the embodiment.

FIG. 2 is a block diagram showing a functional configuration of communication terminal 10. As shown in FIG. 2, communication terminal 10 has a voice inputter-outputter 101, an encoder-decoder 102, a packet processor 103, a communication controller 104, and a data transmitter-receiver 105.

Voice inputter-outputter 101 has a microphone 101*a* and a speaker 101*b*. Voice inputter-outputter 101 obtains voice input by a user through microphone 101*a* to output the obtained voice as speech data to encoder-decoder 102. Voice inputter-outputter 101 also receives the input of speech data decoded by encoder-decoder 102 for output from speaker 101*b*.

Encoder-decoder 102 encodes speech data input from microphone 101*a* so that the speech data can be transmitted from data transmitter-receiver 105. On the other hand, encoder-decoder 102 decodes the input speech data so that the decoded data can be output from speaker 101*b* of voice inputter-outputter 101. Encoder-decoder 102 used for mobile communication is, for example, one of various codecs such as an AMR-narrow band (Adaptive Multi-Rate-narrow band) and an AMR-wide band.

Packet processor 103 divides speech data encoded by encoder-decoder 102 into plural packets for output to data transmitter-receiver 105. Packet processor 103 also assembles packets received from data transmitter-receiver 105 so that speech data can be reproduced after being decoded at encoder-decoder 102. The process performed by packet processor 103 follows a protocol such as an RTP (Real-time Transfer Protocol) for voice communication in an IP system such as VoIP (Voice over Internet Protocol).

Communication controller 104 generates a registration message so that communication terminal 10 can receive a communication service of network N. The generated message is then output to data transmitter-receiver 105. Communication controller 104, upon receiving a response message from a correspondent device via data transmitter-receiver 105, determines that the communication is now enabled. The control process performed by communication controller 104 follows a protocol such as an SIP (Session Initiation Protocol). In a case in which an instruction for terminating communication is input by a user via the operation unit, communication terminal 10, in accordance with the control process performed by communication controller 104, transmits a termination message to a correspondent terminal and terminates communication upon receiving a response message therefrom.

Data transmitter-receiver 105 transmits to, and receives data and messages from, other terminals. Data transmitter-receiver 105 transfers, to network N, speech data input from packet processor 103 and control messages input from communication controller 104. Data transmitter-receiver 105 also outputs speech data received from network N to packet processor 103 and outputs control messages received from network N to communication controller 104.

Communication terminal 10 is, for example, a mobile communication terminal, but it is not limited thereto. For example, communication terminal 10 may be a personal computer capable of performing voice communication or an SIP telephone. However, in this embodiment, description will be given assuming that communication terminal 10 is a mobile communication terminal.

Relay device 20 is connected to network N. Relay device 20 provides a communication function of connecting a communication terminal 10 to another communication terminal 10 via another relay device 20. Relay device 20 is a computer that has a CPU, a RAM, and a ROM as primary storage devices, a communication module for performing communication, and hardware such as a hard disk as the auxiliary storage device (not shown). These elements operate in cooperation with one another, whereby the functions of relay device 20 as described below will be realized.

Figure 3:
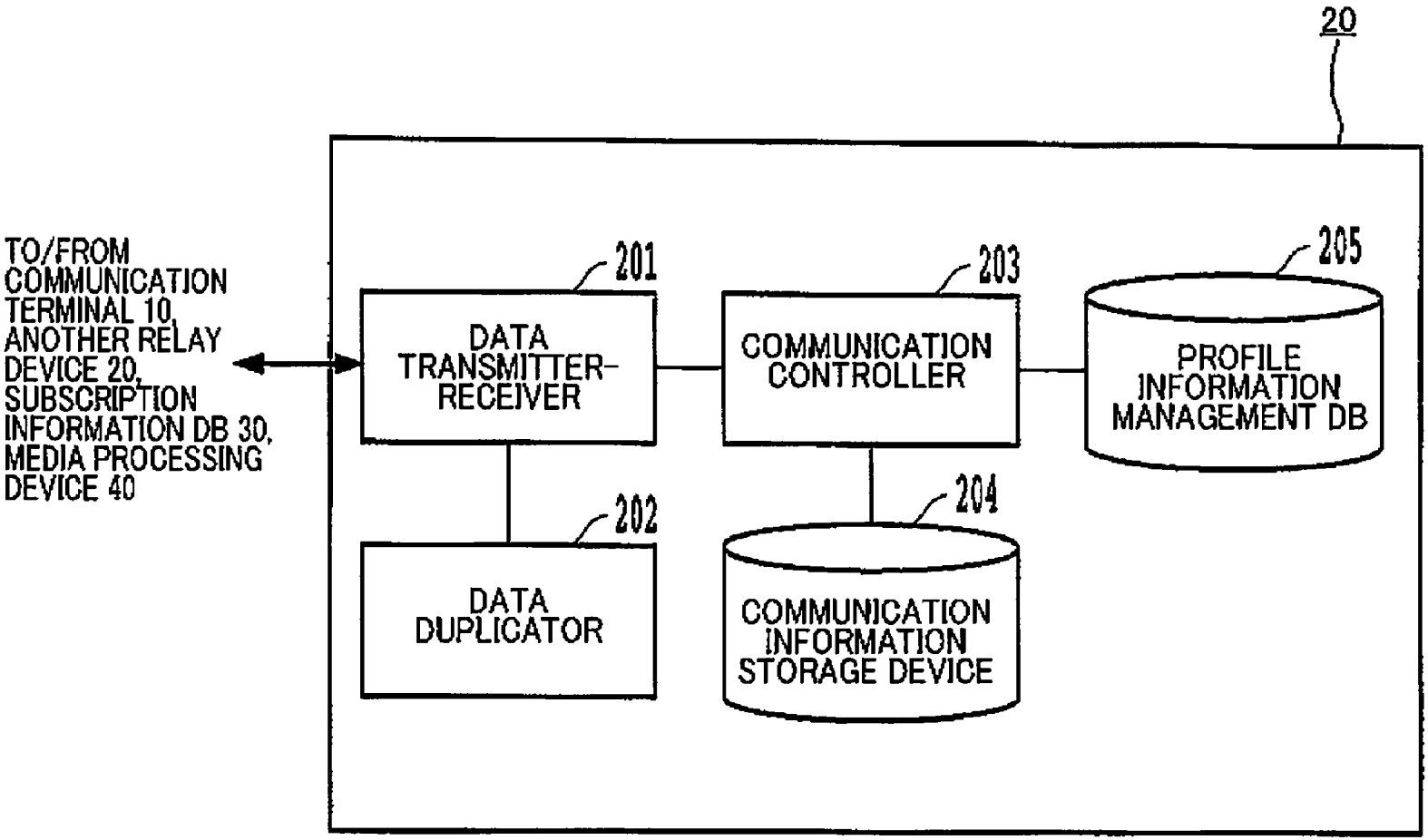
FIG. 3 is a block diagram showing a functional configuration of a relay device according to the embodiment.

FIG. 3 is a block diagram showing a functional configuration of relay device 20. As shown in FIG. 3, relay device 20 has a data transmitter-receiver 201, a data duplicator 202, a communication controller 203, a communication information storage device 204, and a profile information management DB (database) 205. Since in this embodiment communication terminal 10 is a mobile communication terminal, relay device 20 is a base station to which communication terminal 10 connects by wireless, or a router and a switch which communicate with other network elements. In the following, it is assumed that relay device 20 is relay device 20*a*, for the sake of simplicity.

Data transmitter-receiver 201, upon receiving a control message from one of communication terminals 10, another relay device 20 (relay device 20*b* in this embodiment), subscription information DB 30, or media processing device 40, outputs the received message to communication controller 203. Data transmitter-receiver 201 transmits a control message input from communication controller 203 to one of the communication terminals 10, relay device 20*b*, subscription information DB 30, and media processing device 40.

Examples of the control messages received at and transmitted from relay device 20*a* include a registration message from communication terminal 10 for receiving a service from network N, a profile download message for downloading, from subscription information DB 30, profile information of communication terminal 10, a call message for notifying the start of communication, and a response message for responding to the call message. Other examples of the control messages include a receiver connected point inquiry message for inquiring a connected point (i.e., relay device 20) of a correspondent communication terminal, a receiver connected point response message for transmitting the correspondent's connected point as a response to the receiver connected point inquiry message, a termination message from communication terminal 10 for terminating communication with a correspondent communication terminal, a termination message for terminating communication with media processing device 40, and a response message from a correspondent communication terminal 10 or from media processing device 40 for responding to the termination message.

Furthermore, data transmitter-receiver 201, upon receiving a packet indicated by communication controller 203, transfers the packet to data duplicator 202. Data transmitter-receiver 201 transmits a packet duplicated by data duplicator 202 to media processing device 40.

Data duplicator 202 duplicates a packet input from data transmitter-receiver 201. Data duplicator 202 retains an original sender's address in the duplicated packet, but changes the destination address to an IP address of media processing device 40, then outputs the packet to data transmitter-receiver 201.

FIG. 4 shows an example of information stored in communication information storage device 204. As shown in the figure, communication information storage device 204 includes plural records, each record containing the communication terminal identifiers (identification information of communication terminals) and the IP addresses of the caller and the receiver communication terminals 10 that are currently communicated with each other. Furthermore, each record contains service information as to whether each of the caller and receiver communication terminals 10 subscribes to a speech synthesis service. The speech synthesis service is a service provided, for example, by the operator of a mobile communication network and for generating a speech synthesized message corresponding to text specified by a subscriber and transmitting the speech synthesized message to a desired destination.

Each record is generated for each session of voice communication based on profile information of communication terminal 10 connecting to relay device 20, with the profile information downloaded from subscription information DB 30, which will be described later in detail. Each record is deleted after the communication session is terminated (i.e., after receiving a response message that responds to a termination message for terminating communication).

In this embodiment, a phone number is used as a communication terminal identifier so that each communication terminal can be uniquely identified.

Profile information management DB 205 stores profile information downloaded from subscription information DB 30. Profile information downloaded from subscription information DB 30 at least contains a phone number (i.e., communication terminal identifier) of communication terminal 10 that has transmitted a registration message, and service information indicating whether this communication terminal 10 subscribes to a speech synthesis service. Profile information is stored in association with an IP address of each communication terminal 10 and is overwritten with the latest IP address every time profile information having the identical communication terminal identifier is downloaded.

Communication controller 203, upon receiving a control message from data transmitter-receiver 201, performs a process corresponding to the control message. The examples of the control messages are described above.

Communication controller 203, upon receiving a registration message from communication terminal 10 via data transmitter-receiver 201, transmits the message to subscription information DB 30 via data transmitter-receiver 201. In response to this message, profile information of a relevant communication terminal 10 is notified by a profile download message. The received profile information is stored in profile information management DB 205.

Furthermore, communication controller 203, upon receiving a call message from communication terminal 10 via data transmitter-receiver 201, generates a receiver connected point inquiry message to identify a relay device 20 to which a correspondent communication terminal 10 is connected as the forwarding destination of the call message. Communication controller 203 then outputs the generated receiver connected point inquiry message to data transmitter-receiver 201, for transmission to subscription information DB 30. Communication controller 203, upon receiving a receiver connected point response message via data transmitter-receiver 201, identifies relay device 20 to which the correspondent communication terminal 10 is connected, to transmit the call message to the identified relay device 20 via data transmitter-receiver 201. Communication controller 203, upon receiving a response message from the correspondent communication terminal 10, generates a new record in communication information storage device 204.

Communication controller 203, upon receiving a call message from a correspondent relay device 20 via data transmitter-receiver 201, transmits the call message via data transmitter-receiver 201 to relevant communication terminal 10. Communication controller 203, upon receiving a response message for the call message from communication terminal 10 via data transmitter-receiver 201, transmits the response message to the correspondent relay device 20, after reading profile information corresponding to the sender of the response message from profile information management device DB 205 and appending, to the response message, the read profile information and the IP address of the sender communication terminal 10.

Communication controller 203, upon receiving a termination message from communication terminal 10 via data transmitter-receiver 201, transmits, via data transmitter-receiver 201, to each of correspondent relay device 20 and media processing device 40, a termination message. Furthermore, communication controller 203 transmits a response message to communication terminal 10 after it confirms the reception of two response messages, one from correspondent relay device 20 and the other from media processing device 40.

A case is assumed in which profile information notified by a profile download message shows that a user of communication terminal 10*a* subscribes to a speech synthesis service. In this case, when a voice communication call or a videophone call is sent from communication terminal 10*a*, or when a call is received at communication terminal 10*a* from another communication terminal 10*b*, communication controller 203 causes data transmitter-receiver 201 to output speech data corresponding to the dialogues held in the call to data duplicator 202. The output speech data will be duplicated at data duplicator 202, and the duplicated speech data is transmitted to media processing device 40 via data transmitter-receiver 201.

Thus, communication controller 203 causes data duplicator 202 to duplicate speech data received from communication terminal 10*a* and causes data transmitter-receiver 201 to transmit the duplicated speech data to media processing device 40 in a case in which communication terminal 10*a* subscribes to a speech synthesis service. Since the speech data transmitted to media processing device 40 will be stored and will be used as the basis for a speech synthesis database, a database for speech synthesis can be configured based on the actual speech data of a user who subscribes to the speech synthesis service. Therefore, a speech synthesized message generated based on the database created in this way will be a voice message that reflects the individual speech characteristics of the user, i.e., that has a high degree of resemblance to the actual voice of the user.

Furthermore, in a case in which communication terminal 10*b* that is engaged in communication with communication terminal 10*a* subscribes to a speech synthesis service, communication controller 203 of relay device 20*a* connected to communication terminal 10*a* causes its data duplicator 202 to duplicate speech data received from communication terminal 10*b*. In a case in which both communication terminal 10*a* and its correspondent communication terminal 10*b* subscribe to a speech synthesis service, communication controller 203 of relay device 20*a* causes its data duplicator 202 to duplicate both speech data received from communication terminal 10*a* and speech data received from communication terminal 10*b*. Thus, according to the communication system of the present invention, a speech synthesis database can also be configured for a user of a correspondent communication terminal.

It should be noted that the response message transmitted as a response to a call message is not only for responding to the incoming call, but that it is also for notifying an IP address of the receiver communication terminal 10. As a result, relay device 20 to which the caller communication terminal 10 is connected will have information on the communication terminal identifiers and IP addresses of both the caller and receiver communication terminals 10, so that the information is stored in communication information storage device 204. As described above, the communication terminal identifiers and IP addresses of caller and receiver communication terminals 10 during a call are maintained at communication information storage device 204.

Communication controller 203, upon receiving a response message from a correspondent communication terminal 10, generates a call message so as to establish a communication path with media processing device 40, for transmission to media processing device 40. The duplication of a packet is started at data duplicator 202 after receiving a response message from media processing device 40.

Subscription information DB 30 is connected to network N and is a database server device that manages the subscription information for all communication terminals 10 that are contracted to an operator of network N and information on a located place of each communication terminal 10. In a mobile communication system, subscription information DB 30 is, for example, an HLR (Home Location Register). Subscription information DB 30 is a computer that has a CPU, a RAM, and a ROM as primary storage devices, a communication module for performing communication, and hardware such as a hard disk as an auxiliary storage device (not shown). These elements operate in cooperation with one another, whereby the following functions of subscription information DB 30 are realized.

FIG. 5 shows an example of information registered in subscription information DB 30. As shown in the figure, a user ID, a phone number, "YES" or "NO" regarding subscription to the speech synthesis service, and a registration state for each communication terminal 10 are registered as subscription information 301. In this embodiment, the phone number stored in the subscription information DB serves as a communication terminal identifier of communication terminal 10. The registration state shows by IP address of relay device 20 to which relay device 20 communication terminal 10 is connected in a case in which communication terminal 10 is registered (i.e., is turned on). The IP address of relay device 20 is transmitted from relay device 20 together with a registration message. In this sense, a registration message is equivalent to a location registration request message.

Subscription information DB 30, upon receiving a registration message from relay device 20, registers, under the item of the registration state, information identifying relay device 20 to which communication terminal 10 that has transmitted the registration message is connected. Furthermore, subscription information DB 30 transfers, in a profile download message to relay device 20, the phone number and the service information indicating YES or NO to the speech synthesis service as the profile information of communication terminal 10. Additionally, in a case in which subscription information DB 30 receives a receiver connected point inquiry message for inquiring about a connected point of a receiver communication terminal 10 (i.e., relay device 20 to which communication terminal 10 is connected), subscription information DB 30 transmits the connected point of the receiver communication terminal 10 to relay device 20 that has transmitted the inquiry after including the information on the connected point in a receiver connected point response message.

Media processing device 40 is connected to network N and provides functions of storing and processing multimedia information of communication terminal 10. Media processing device 40 is a computer that has a CPU, a RAM, and a ROM as primary storage devices, a communication module for performing communication, and hardware such as a hard disk as an auxiliary storage device (not shown). These elements operate in cooperation with one another, whereby the following functions of media processing device 40 are realized.

Figure 6:
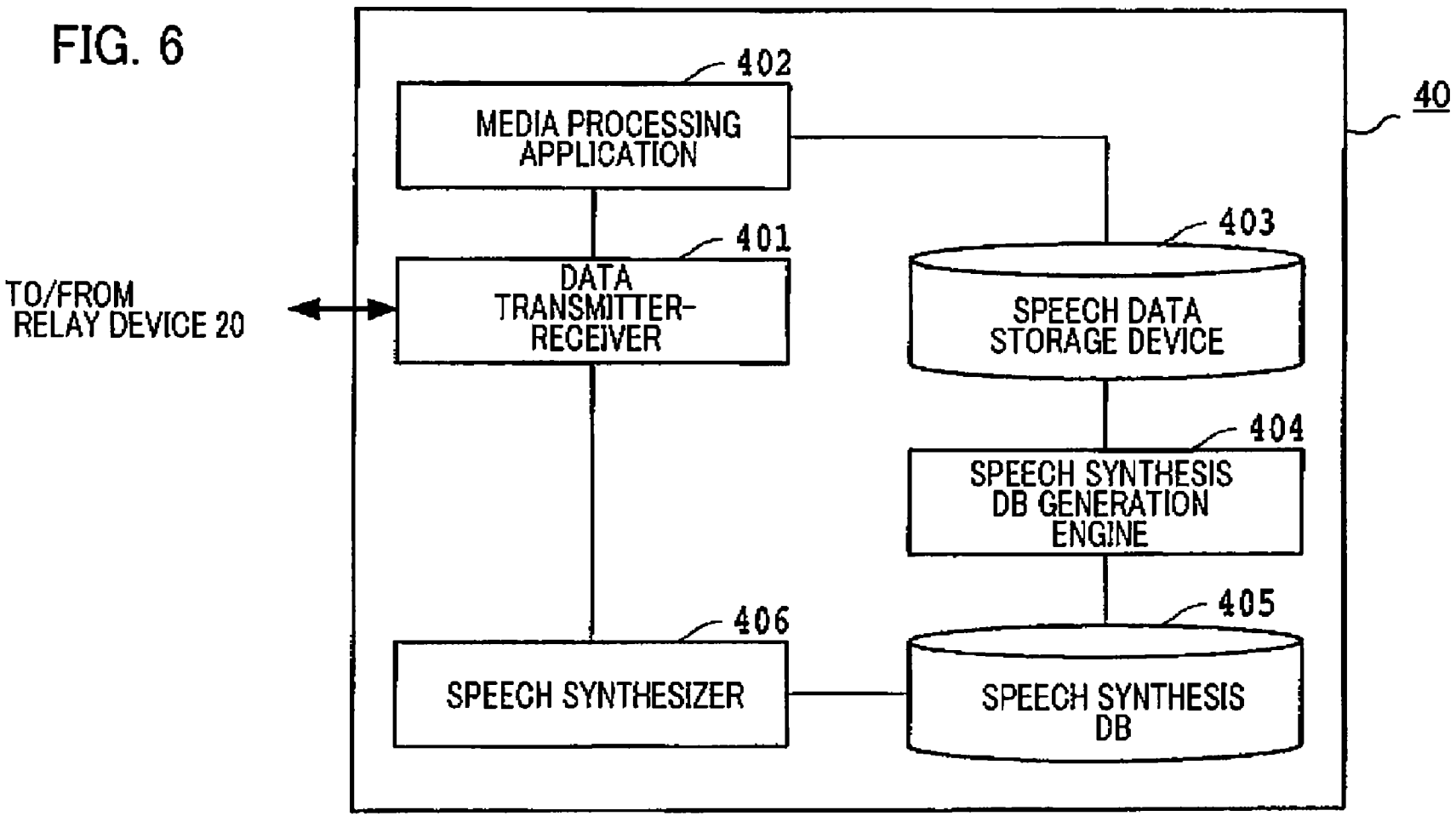
FIG. 6 is a block diagram showing a functional configuration of a media processing device according to the embodiment.

FIG. 6 is a block diagram showing a functional configuration of media processing device 40. As shown in the figure, media processing device 40 has a data transmitter-receiver 401, a media processing application 402 (speech data processor), a speech data storage device 403, a speech synthesis DB generation engine 404, a speech synthesis DB (database) (speech synthesis database storage device) 405, and a speech synthesizer 406.

Data transmitter-receiver 401, upon receiving a control message from relay device 20, transfers the message to media processing application 402. Data transmitter-receiver 401 transfers the control message received from media processing application 402 to relay device 20. Data transmitter-receiver 401 also transmits a packet received from relay device 20 to media processing application 402. Data transmitter-receiver 401, upon receiving a speech synthesis request message for requesting speech synthesis from communication terminal 10, outputs the message to speech synthesizer 406. Transmitted together with the speech synthesis request message is the data of instant messages (Instant messaging) or the text data of electronic mail.

Media processing application 402, upon receiving a call message from relay device 20, transmits a response message. The call message includes a communication terminal identifier and an IP address of the caller communication terminal. When a packet is received from relay device 20 at a later point in time, media processing application 402 sorts each packet by sender IP address, and each received, sorted packet is stored in a memory storage space for a communication terminal under a corresponding IP address in speech data storage device 403. This storing process is performed every time a packet is received from relay device 20. Media processing application 402, upon receiving a termination message from relay device 20, transmits a response message acknowledging the termination message. Media processing application 402 further instructs speech data storage device 403 to store the stored packets in one data file.

Speech synthesis DB engine 404, in a case in which the data file for speech synthesis is registered at speech data storage device 403, obtains the data file from speech data storage device 403, to create a database for speech synthesis. The generated database is stored in speech synthesis DB 405.

Speech synthesizer 406, upon receiving a speech synthesis request message from communication terminal 10, obtains, from speech synthesis DB 405, data for speech synthesis of the transmitter communication terminal 10, to perform a speech synthesis process. A speech synthesized message is transferred to a receiver communication terminal 10.

Figure 8:
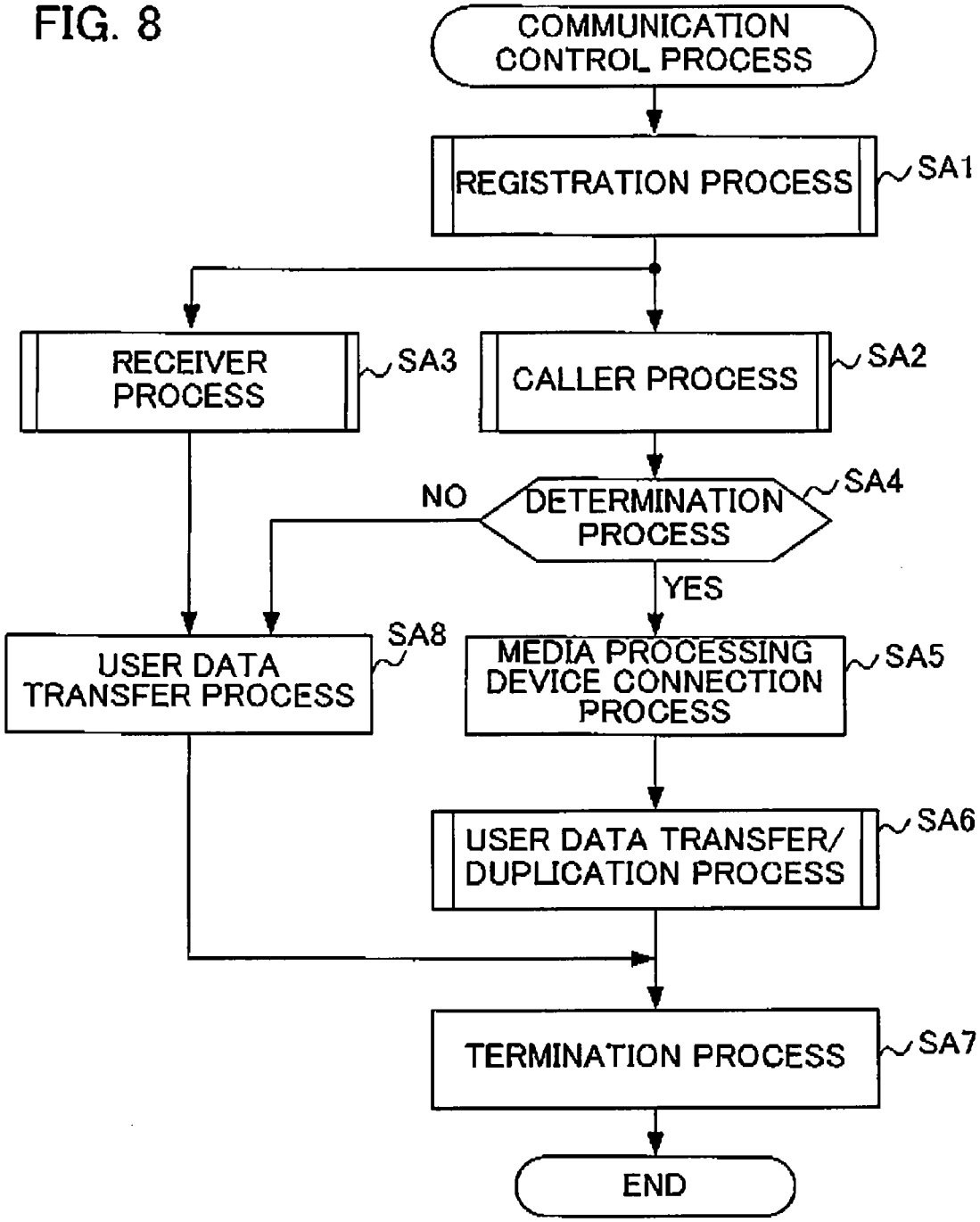
FIG. 8 is a flowchart showing a communication control process performed by the relay device.

FIG. 8 is a flowchart showing a simplified communication control process performed by communication controller 203 of relay device 20. As shown in the figure, in the communication control process, communication controller 203 first performs a registration process (SA1) upon receiving a registration request from communication terminal 10. The registration request is transmitted, for example, when mobile communication terminal 10 is turned on. After the registration process is completed, communication controller 203 waits for another control message.

In a case in which a control message is received and the received control message is a call message from communication terminal 10 that connects to this relay device 20, communication controller 203 first performs a caller process (SA2). Communication controller 203 then performs a determination process (SA4) for determining whether at least one of caller communication terminal 10 connecting to this relay device 20 and receiver communication terminal 10 connecting to another relay device 20 subscribes to the speech synthesis service based on the information stored in communication information storage device 204. If the determination changes to YES, communication controller 203 proceeds to a media processing device connection process (SA5) for establishing a communication connection with media processing device 40. Communication controller 203 subsequently performs a user data transfer and duplication process (SA6). Communication controller 203 then performs a termination process (SA7) for terminating the communication session. In a case in which the determination of Step SA4 changes to NO, communication controller 203 proceeds to a user data transfer process (SA8). The user data transfer process is performed every time user data is received, and then the termination process is performed in a case in which a termination message is received (SA7).

On the other hand, in a case in which a control message is received and the received control message is a call message from another relay device 20, communication controller 203 first performs a receiver process (SA3). Once a communication connection between communication terminal 10 connecting to this relay device 20 and another communication terminal 10 connecting to another relay device 20 is established by the receiver process, communication controller 203 starts transferring user data received from communication terminal 10 connecting to this relay device to another relay device 20 and user data received from another relay device 20 to communication terminal 10 connecting this relay device 20 (SA8). The user data transfer process is performed every time user data is received, and in a case in which a termination message is received, the routine then proceeds to the termination process (SA7). In the termination process, communication controller 203, upon receiving a termination message from communication terminal 10, terminates a communication with another relay device 20. Communication controller 203 also terminates a communication with media processing device 40 in a case in which this relay device 20 is in communication with relay device 40.

Figure 7A:
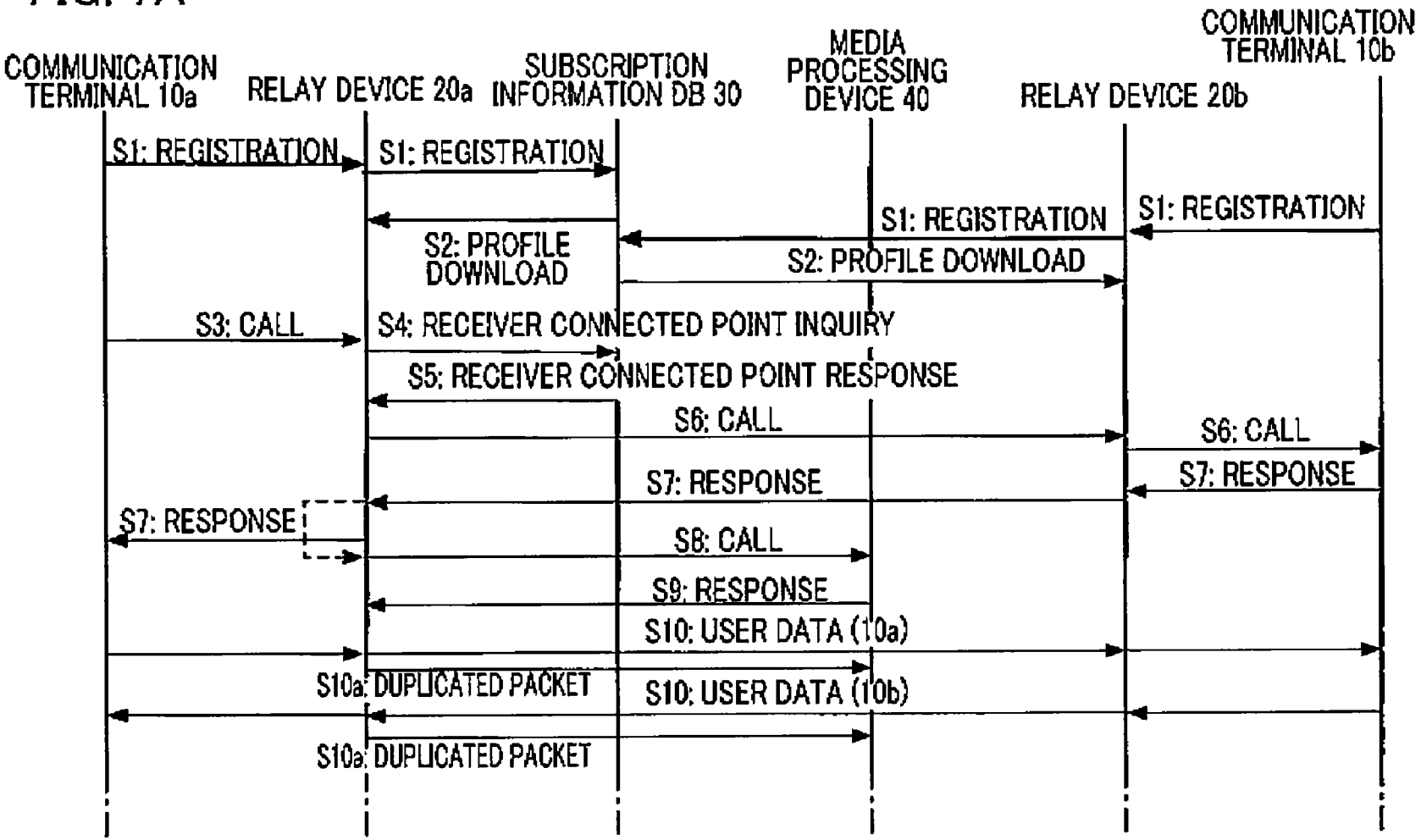
FIGS. 7A and 7B are a sequence chart showing a flow of information exchanged in the communication system according to the embodiment.
Figure 7B:
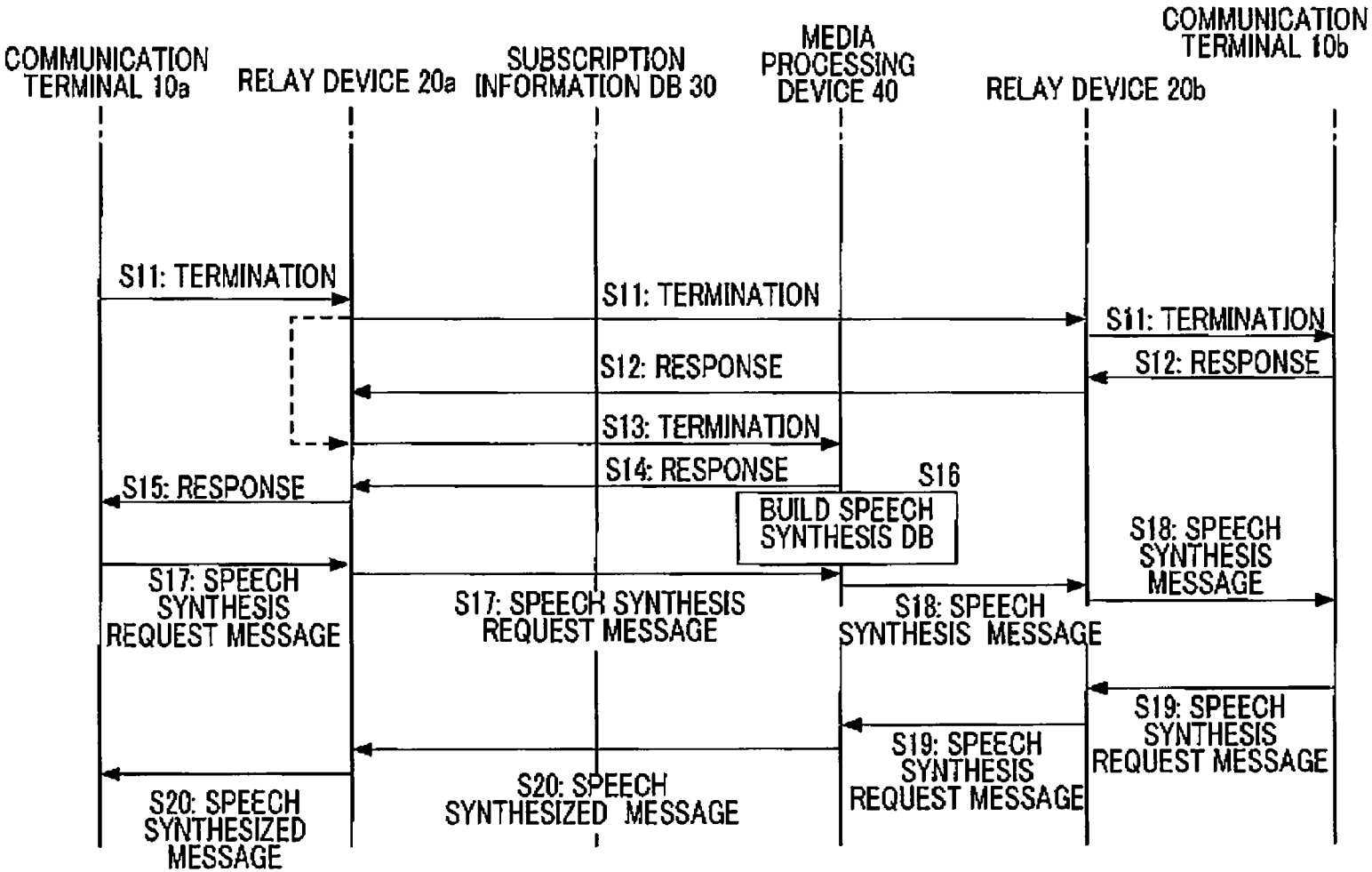

FIGS. 7A and 7B are a sequence chart together showing a flow of data exchanged in the communication system. FIGS. 9 to 12 show the detailed flow of the registration process (SA1 in FIG. 8), the caller process (SA2 in FIG. 8), the receiver process (SA3 in FIG. 8), and the user data transfer and duplication process (SA6 in FIG. 8), respectively.

Description will be next given of an example of a process performed in the communication system, with reference to FIGS. 7A and 7B and also to FIGS. 9 to 12. In this process, two communication terminals 10*a* and 10*b* perform voice communication, and during this communication, packets are stored in media processing device 40, and communication terminals 10*a* and 10*b* each transmit a speech synthesis request message after the communication is terminated.

In Step S1 in FIG. 7A, communication terminals 10*a* and 10*b* transmit a registration message respectively to relay devices 20*a* and 20*b*, for example when the power is turned on, so that the terminals can receive a service from network N. Each relay device 20*a* and 20*b* transmits this registration message to subscription information DB 30. At that time, each relay device 20*a* and 20*b* informs subscription information DB 30 of an IP address of each relay device 20*a* and 20*b* so that it is possible to find out which relay device each communication terminal 10*a* and 10*b* is connected to. Subscription information DB 30 then registers, as registration states, the IP addresses of relay devices 20*a* and 20*b* to which respective communication terminals 10*a* and 10*b* are connected.

In Step S2, subscription information DB 30 that has received the registration message extracts profile information of each of the communication terminals 10*a* and 10*b* to transmit the profile information to each of the IP addresses of relay devices 20*a* and 20*b* informed by the registration message (S2: PROFILE DOWNLOAD in FIG. 7A). Each relay device 20*a* and 20*b* registers the received profile information in the profile information management DB 205 in each relay device 20.

Figure 9:
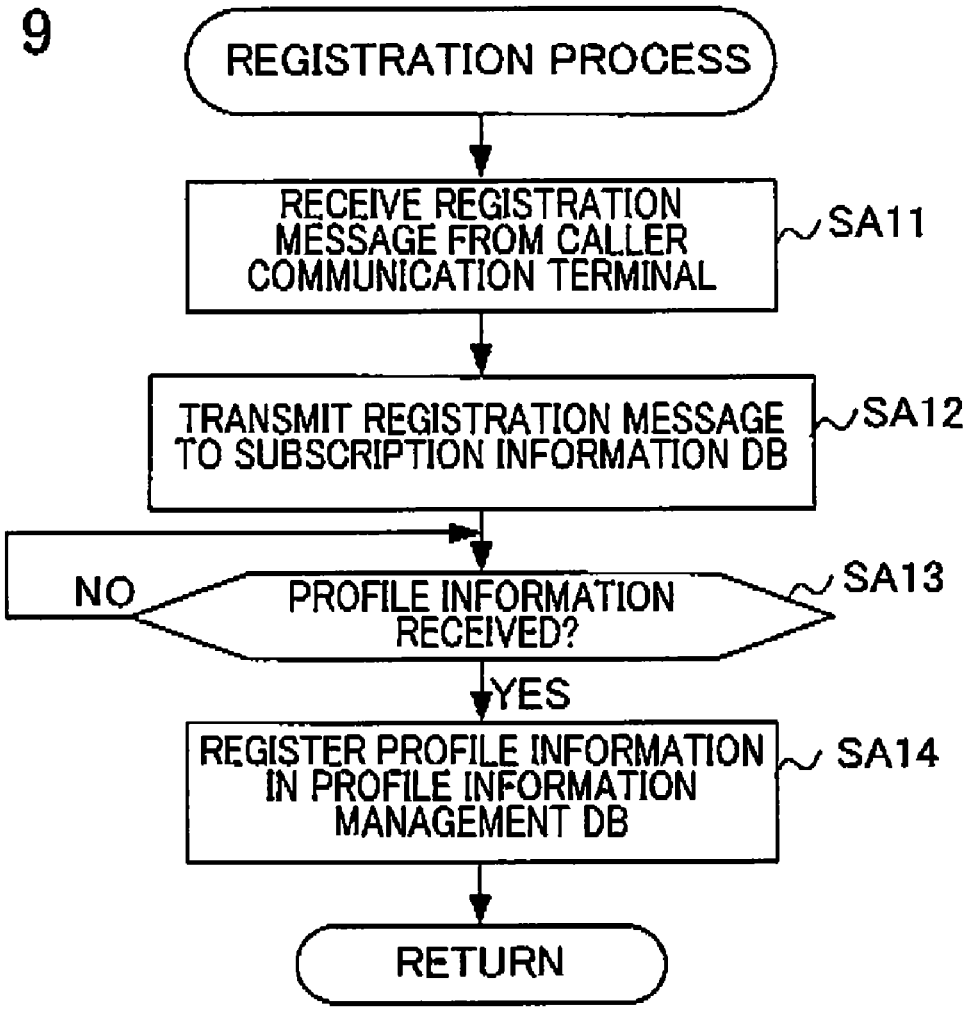
FIG. 9 is a flowchart showing a flow of a registration process performed by the relay device.

FIG. 9 is a flowchart showing a flow of a registration process performed by communication controller 203 of relay device 20. In the registration process, communication controller 203 first receives a registration message from communication terminal 10 (SA11). Communication controller 203 then transmits the received registration message to subscription information DB (SA12). In transmitting the registration message, communication controller 203 appends an IP address of relay device 20 to the registration message.

Communication controller 203 then determines whether profile information is received from subscription information DB 30 (SA13). This determination is repeated until profile information is received (SA13: NO). In a case in which the determination changes to YES, communication controller 203 registers the received profile information in profile information management DB 205 (SA14), to end the registration process.

As shown in FIG. 7A, this registration process is performed by each of relay devices 20*a* and 20*b*.

In Step S3 in FIG. 7A, communication terminal 10*a* transmits a call message for communication terminal 10*b*.

In Step S4 in FIG. 7A, relay device 20*a* makes an inquiry to subscription information DB 30 about a relay device to which communication terminal 10*b* is connected by transmitting a receiver connected point inquiry.

In Step S5 in FIG. 7A, in a case in which the registration of communication terminal 10*b* is completed, subscription information DB 30 determines that communication terminal 10*b* is connected to relay device 20*b*, to transmit information indicating relay device 20*b* to relay device 20*a* (S5: RECEIVER CONNECTED POINT RESPONSE in FIG. 7A).

In Step S6 in FIG. 7A, relay device 20*a* transmits a call message to relay device 20*b*, which was informed by subscription information DB 30 as a relay device to which communication terminal 10*b* is connected. Relay device 20*b*, having received the call message, transmits the same call message to communication terminal 10*b* and also records the transmitter address of the received call message.

In Step S7 in FIG. 7A, communication terminal 10*b* transmits a response message to relay device 20*b* in a case in which communication terminal 10*b* is able to respond to the call message. Relay device 20*b* transmits the received response message to relay device 20*a* after appending an IP address of communication terminal 10*b* and profile information. Relay device 20*a* then transmits the response message to communication terminal 10*a*. In this embodiment, relay device 20*b* can transmit a message to relay device 20*a* because relay device 20*b* recorded the transmitter address of the call message received in Step S6.

Figure 10:
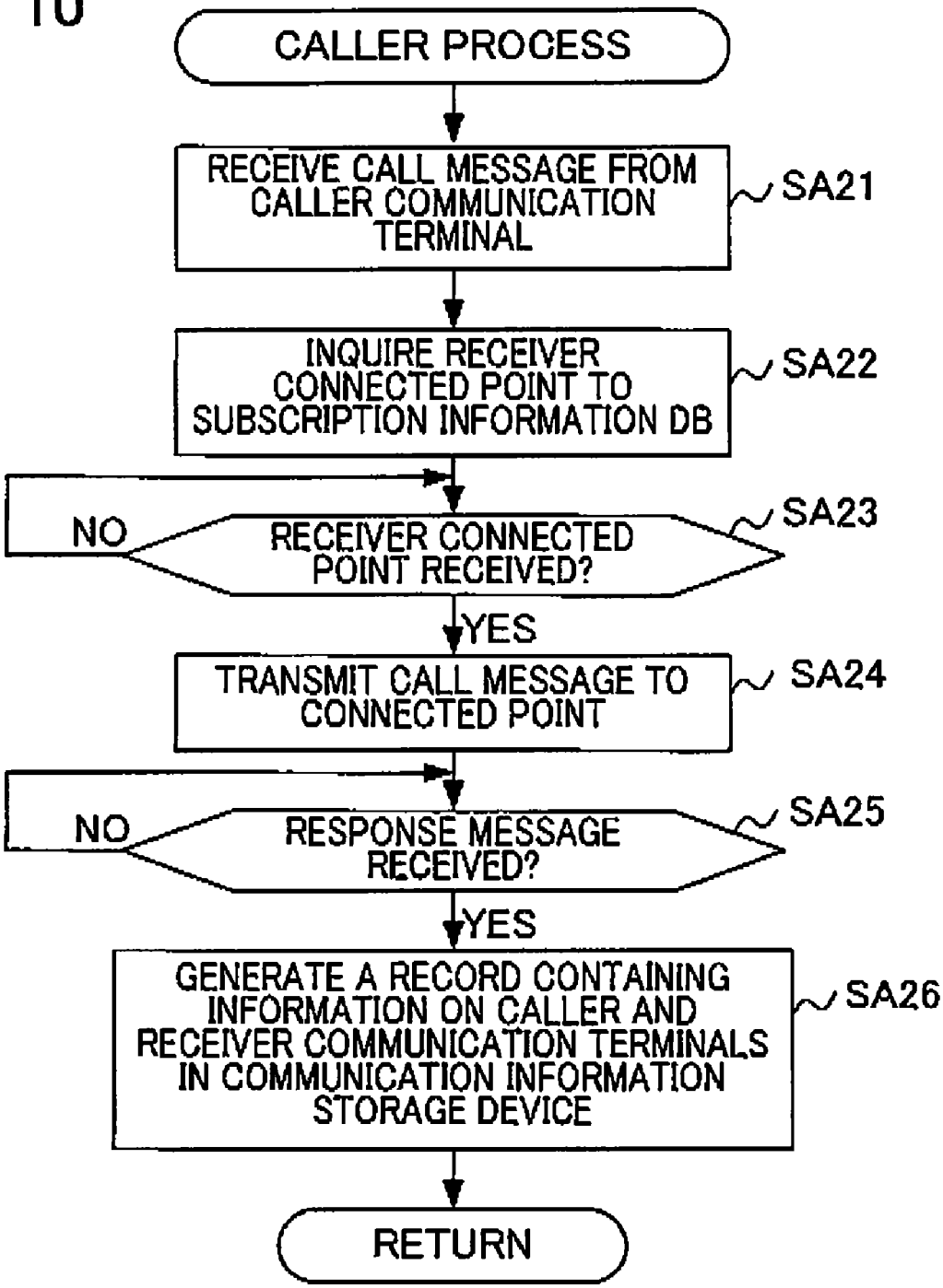
FIG. 10 is a flowchart showing a flow of a caller process performed by the relay device.

FIG. 10 is flowchart showing a flow of a caller process performed by communication controller 203 of relay device 20 (relay device 20*a* in the example shown in FIG. 7A; therefore, communication controller 203 will be hereinafter referred to as a "communication controller 203*a*" in this process). In the caller process, communication controller 203*a* first receives a call message from communication terminal 10*a* that is a caller communication terminal (SA21). Communication controller 203*a* then inquires, by transmitting a receiver connected point inquiry to subscription information database 30, about a connected point of a receiver communication terminal 10*b* specified in the call message (SA22).

Communication controller 203*a* then determines whether information on the receiver connected point is received from subscription information DB 30 (SA23). This determination is repeated until information on the receiver connected point is received (SA23: NO). In a case in which the determination changes to YES, communication controller 203*a* transmits the call message to relay device 20 (relay device 20*b* in the example shown in FIG. 7A) indicated by the information on the receiver connected point (SA24). The call message is transferred from relay device 20*b* to communication terminal 10*b* as shown in Step S6 in FIG. 7A.

Figure 11:
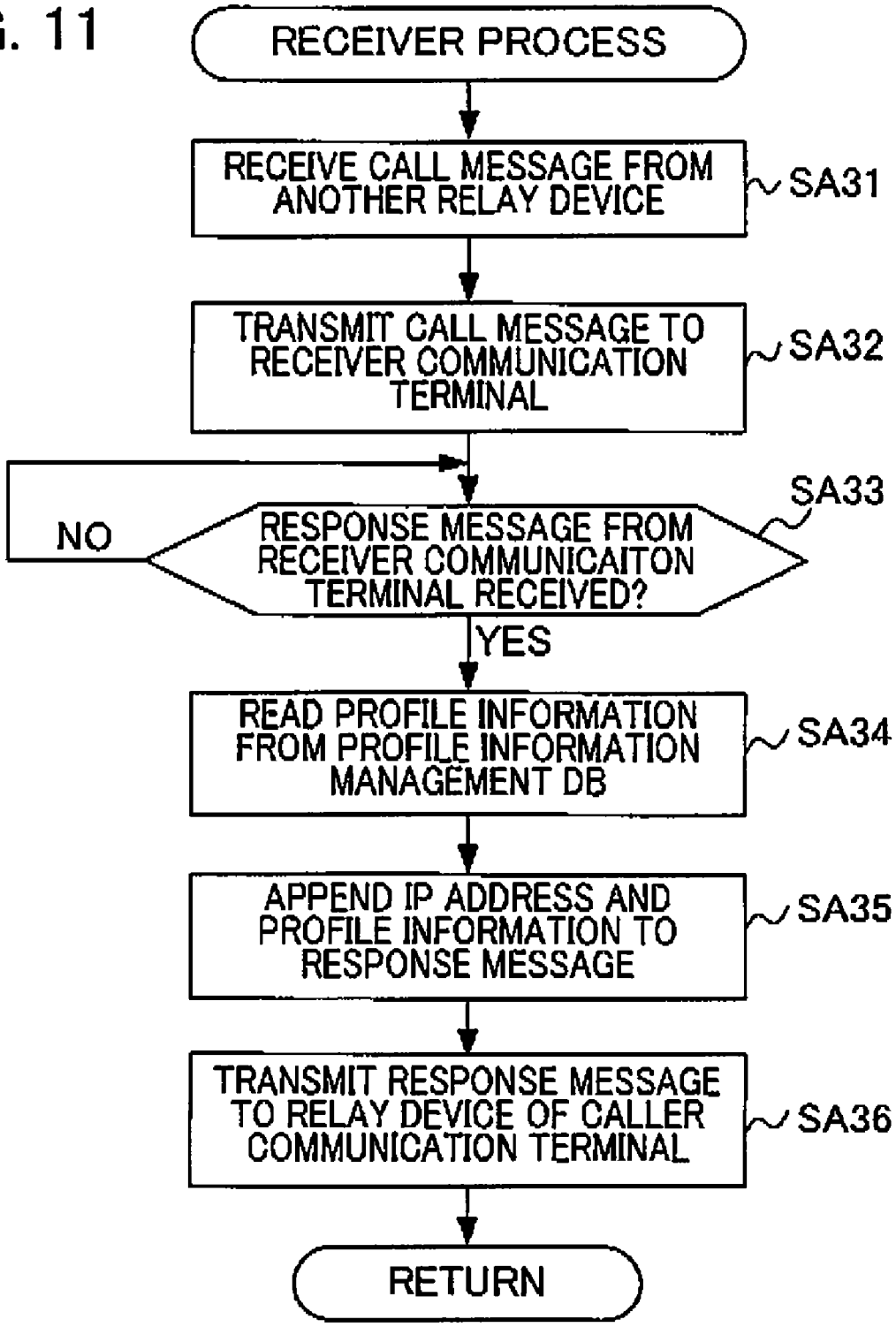
FIG. 11 is a flowchart showing a flow of a receiver process performed by the relay device.

FIG. 11 is a flowchart showing a flow of a receiver process performed by communication controller 203 of relay device 20 (i.e., relay device 20*b* in the example shown in FIG. 7A; therefore, communication controller 203 will be hereinafter referred to as a "communication controller 203*b*" in this process). In the receiver process, communication controller 203*b* first receives the call message from relay device 20*a* (SA31). Communication controller 203*b* then transmits the call message to the receiver communication terminal 10*b* (SA32) and waits for a response message for the transmitted call message (SA33: NO).

Upon receiving the response message from communication terminal 10*b* (SA33: YES), communicator controller 203*b* reads profile information of communication terminal 10*b* from profile information management DB 205 (SA34), appends an IP address and the read profile information of communication terminal 10*b* to the response message (SA35), and transmits the response message together with the appended information to relay device 20*a* (SA36), to end the receiver process.

On the other hand, in Step SA25 in FIG. 10, communication controller 203*a* of relay device 20*a* determines whether a response message is received from communication terminal 10*b* via relay device 20*b* (SA25). This determination is repeated until the response message is received (SA25: NO).

In a case in which the determination changes to YES, communication controller 203*a* generates a new record in communication information storage device 204. Specifically, communication controller 203*a* obtains the communication terminal identifier of communication terminal 10*b* and service information indicating whether communication terminal 10*b* subscribes to the speech synthesis service based on the received profile information. Communication controller 203*a* then stores, in the new record, the communication terminal identifier, the service information, and the received IP address of communication terminal 10*b*. Communication controller 203*a* also reads profile information corresponding to an IP address contained in the caller message received in SA21 (i.e., an IP address of communication terminal 10*a*) from profile information management DB 205 and obtains the communication terminal identifier of communication terminal 10*a* and service information indicating whether communication terminal 10*a* subscribes to the speech synthesis service, for storage in the new record together with the IP address of communication terminal 10*a* (SA26).

In this example, we assume that, as a result of the process performed in Step SA26, the top record in communication information storage device 204 as shown in FIG. 4 is generated, with the communication terminal identifier of communication terminal 10*a* being "090AAAAAAAA" and that of communication terminal 10*b* being "090BBBBBBBB". Therefore, both communication terminals 10*a* and 10*b* subscribe to the speech synthesis service in this example.

Communication controller 203*a* then ends the caller process to advance the process to the determination process in Step SA4 in FIG. 8.

In the determination process, relay device 20*a* determines whether at least one of the caller and receiver communication terminals subscribes to the speech synthesis service based on the information stored in communication information storage device 204. Since, in this example, it is determined to be in the affirmative based on the information stored in communication information storage device 204 (SA4 in FIG. 8: YES), relay device 20*a* generates a call message for establishing a communication path, for transmission to media processing device 40 (S8: CALL in FIG. 7A, SA5 in FIG. 8). In a case in which it is determined that none of the caller and receiver communication terminals subscribes to the speech synthesis service (SA4 in FIG. 8: NO), communication controller 203 does not transmit a call message to media processing device 40. Instead, communication controller 203 proceeds to the user data transfer process (SA8 in FIG. 8).

In Step S9 in FIG. 7A, media processing device 40, after it receives the call message, transmits a response message to relay device 20*a*, thereby establishing the communication path with relay device 20*a*.

In Step S10 in FIG. 7A, in a case in which a packet containing user data (speech data) is transmitted to relay device 20*a* from communication terminal 10*a*, relay device 20*a* transmits the packet to a relay device 20*b* connected to the correspondent communication terminal 10*b*. Since, in this example, communication terminal 10*a* subscribes to the speech synthesis service, relay device 20*a* duplicates the packet, for transmission to media processing device 40. In a case in which a packet is transmitted to relay device 20*a* from communication terminal 10*b* via relay device 20*b*, and since in this example, communication terminal 10*b* also subscribes to the speech synthesis service, relay device 20*a* duplicates the packet, for transmission to media processing device 40 (S10*a*: DUPLICATED PACKET in FIG. 7A). Media processing device 40 sorts received packets by the original sender address (i.e., IP address of communication terminals 10*a* or 10*b*) and stores data of each packet in a memory storage space corresponding to a communication terminal identifier corresponding to the sender address in speech data storage device 403.

Figure 12:
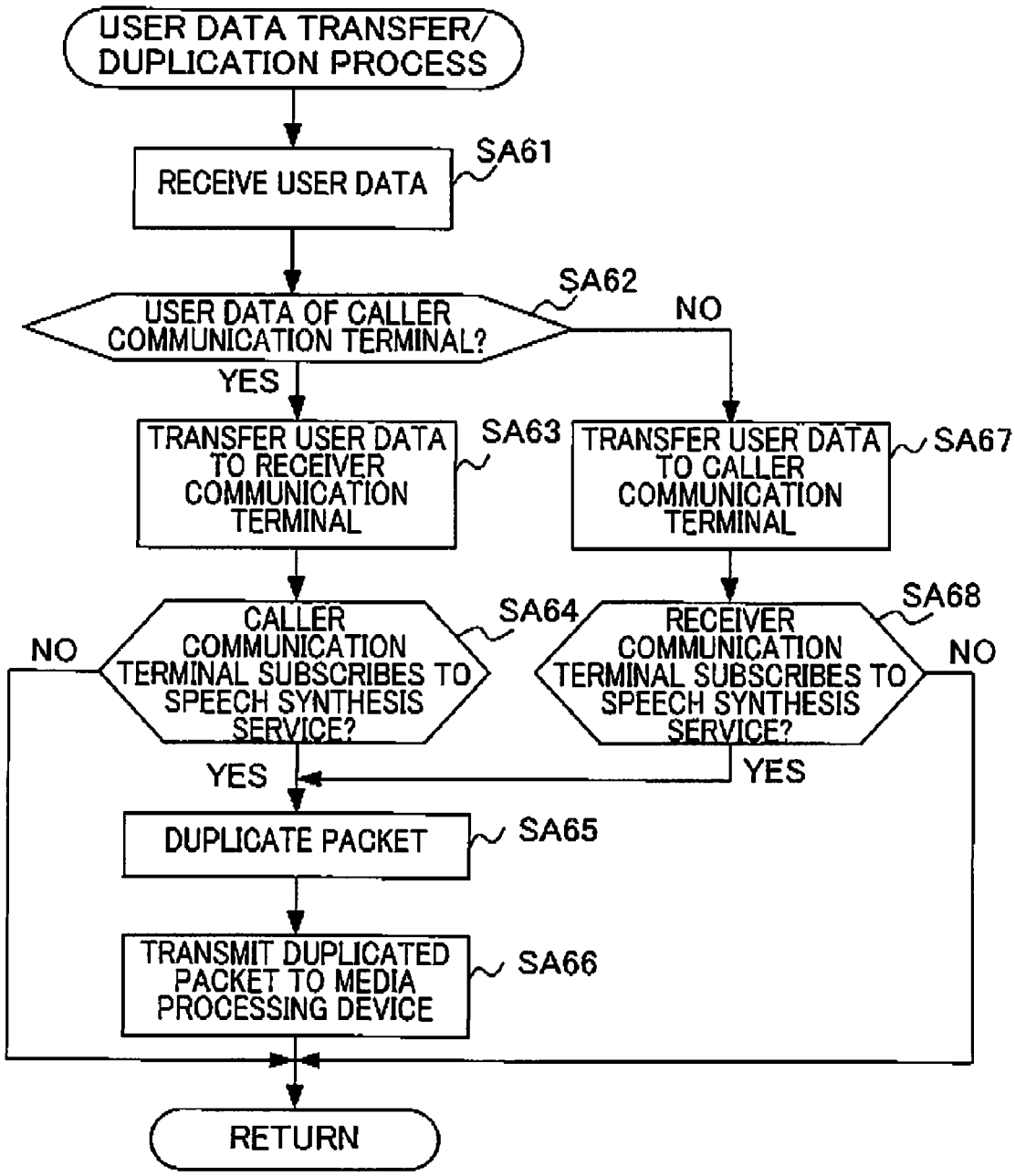
FIG. 12 is a flowchart showing a flow of a user data transfer and duplication process performed by the relay device.

FIG. 12 is a flowchart showing a flow of a user data transfer and duplication process performed by communication controller 203*a*. In this process, communication controller 203*a* first receives user data (SA61). Communication controller 203*a* then determines whether the received user data is transmitted from a caller communication terminal that has transmitted the call message received in Step SA21 (i.e., communication terminal 10*a*) (SA62).

In a case in which the determination changes to YES, communication controller 203*a* transfers the user data to a receiver communication terminal (i.e., communication terminal 10*b*) (SA63). Communication controller 203*a* then determines whether communication terminal 10*a* subscribes to the speech synthesis service (SA64) based on the information stored in communication information storage device 204. In this example, since communication terminal 10*a* subscribes to the speech synthesis service, the determination changes to YES. Therefore, communication controller 203*a* causes data duplicator 202 to duplicate user data (SA65) and transmits the duplicated user data to media processing device 40 via data transmitter-receiver 201 (SA66), to end the process. In a case in which the determination of Step SA64 changes to NO, the routine returns to the main process in FIG. 8.

On the other hand, in a case in which the determination of Step SA62 changes to NO, i.e., in a case in which the received user data is transmitted from communication terminal 10*b*, communication controller 203*a* transfers the user data to a receiver communication terminal (i.e., communication terminal 10*a*) (SA67). Communication controller 203*a* then determines whether communication terminal 10*b* subscribes to the speech synthesis service (SA68) based on the information stored in communication information storage device 204. In this example, since communication terminal 10*b* subscribes to the speech synthesis service, the determination changes to YES. Therefore, communication controller 203*a* causes data duplicator 202 to duplicate user data (SA65) and transmits the duplicated user data to media processing device 40 via data transmitter-receiver 201 (SA66), to end the process. In a case in which the determination of Step SA68 changes to NO, the routine returns to the main process in FIG. 8. This user data transfer duplication process is performed every time user data is received.

In Step S11 in FIG. 7B, in a case in which an instruction for terminating the communication is input by a user, communication terminal 10*a* transmits a termination message. Relay device 20*a*, upon receiving the termination message, transfers the message to relay device 20*b*. Relay device 20*b* subsequently transfers the message to communication terminal 10*b*.

In Step S12 in FIG. 7B, communication terminal 10*b*, after it receives the termination message to terminate the voice communication, transmits a response message to relay device 20*b*. Relay device 20*b*, upon receiving the response message, transfers the message to relay device 20*a*. Relay device 20*b* is able to transmit the message to relay device 20*a* for the same reason described with respect to Step S7.

In Step S13 in FIG. 7B, relay device 20*a*, upon receiving the termination message from communication terminal 10*a*, stops a duplication function of a packet in relay device 20*a* and transmits a termination message to media processing device 40.

In Step S14 in FIG. 7B, media processing device 40, upon receiving the termination message, transmits a response message, thereby terminating communication with relay device 20*a*. In this case, media processing device 40 determines that a voice communication has been completed and data included in each of duplicated packets that have been stored in speech data storage device 403 are combined as one data file.

In Step S15 in FIG. 7B, relay device 20*a*, in a case in which it receives a response message from both of relay device 20*b* and media processing device 40, transmits the response message to communication terminal 10*a* informing it that the communication has been terminated (Steps S11 to S15 correspond to SA7 in FIG. 8). Thus, the communication session between communication terminals 10*a* and 10*b* is terminated.

In Step S16 in FIG. 7B, media processing device 40, builds a database to be used for speech synthesis based on the data file on the voice communication stored in speech data storage device 403.

The speech synthesis DB generated in Step S16 is used when a speech synthesis task is requested by message data transmitted from communication terminal 10*a* or 10*b* by a messaging application such as an electronic mail and an instant message.

In Step S17, communication terminal 10*a* transmits, to relay device 20*a*, a message for communication terminal 10*b* including a request for speech synthesis. Relay device 20*a* transmits the received message to media processing device 40 (S17: SPEECH SYNTHESIS REQUEST MESSAGE in FIG. 7B).

In Step S18, media processing device 40 generates a speech synthesized message that reflects the individual speech characteristics of a user of communication terminal 10*a* based on the speech synthesis DB, for transmission to communication terminal 10*b* via relay device 20*b* (S18: SPEECH SYNTHESIZED MESSAGE in FIG. 7B).

In Step S19, communication terminal 10*b* transmits, to relay device 20*b*, a message for communication terminal 10*a* including a request for speech synthesis. Relay device 20*b* transmits the received message to media processing device 40 (S19: SPEECH SYNTHESIS REQUEST MESSAGE in FIG. 7B).

In Step S20, media processing device 40 generates a speech synthesized message that reflects the individual speech characteristics of a user of communication terminal 10*b* based on the speech synthesis DB, for transmission to communication terminal 10*a* via relay device 20*a* (S20: SPEECH SYNTHESIZED MESSAGE in FIG. 7B).

Modifications

The above-described embodiments can be modified as described in the following.

In the above embodiment, in a situation in which communication terminal 10*a* calls communication terminal 10*b*, relay device 20*a*, to which communication terminal 10*a* is connected, duplicates speech data both for communication terminal 10*a* and 10*b*, and relay device 20*a* transmits the duplicated speech data to media processing device 40. However, since in this case, relay device 20*b* also has the same configuration as relay device 20*a*, relay device 20*b* may duplicate speech data both for communication terminal 10*a* and 10*b*. Alternatively, the system may be configured so that relay devices 20*a* and 20*b* each duplicate speech data both for communication terminal 10*a* and 10*b*. In another alternative, each of the relay devices 20*a* and 20*b* may duplicate speech data for communication terminal 10*a* and speech data for communication terminal 10*b*, respectively.

Furthermore, in the above embodiment, description was given of a case in which communication terminal 10*a* is connected to relay device 20*a* and in which communication terminal 10*b* is connected to relay device 20*b*. However, both communication terminals 10*a* and 10*b* may be connected to the same relay device 20. Also, at least one of the communication terminals 10 may be connected to relay device 20. That is, one of the communication terminals may be connected to a conventional relay device that does not have the same functions as relay device 20.

In the above embodiment, all pieces of data included in the voice communication transferred to media processing device 40 are stored therein, but only selected pieces of the transferred data may be stored. This selection may be performed based on comparison of the stored data and received data, in which pieces of data that are identical or are similar to the stored data in terms of pronunciation and meaning are discarded. In this case, media processing application 402 of media processing device 40 may have a determiner that determines whether a piece of speech data received by the receiver corresponds to any piece of the stored speech data, and media processing application 402 may overwrite the stored piece of speech data with the received piece of speech data in a case in which the correspondence is found by the determiner.

Preferably, a stored piece of data may be replaced with a received piece of data that is identical or is similar to the stored piece of data in a case in which the stored piece of data contains background noise and the newly received piece of data has higher acoustic quality than the stored piece of data. In this case, media processing application 402 may have a noise measurer that measures the amount of noise contained in the received piece of speech data and the amount of noise contained in the corresponding piece of stored speech data, and speech data storage device 403 may overwrite the stored piece of speech data with the received piece of speech data in a case in which the amount of noise in the received piece of speech data is less than that of the corresponding piece of stored speech data. According to this configuration, a speech synthesis database with higher quality can be provided, while optimizing the size of the database.

Preferably, pieces of data that are frequently used in speech synthesized messages may be preferentially stored, so that the replacement of these frequently used pieces of data will not take place due to the input of new pieces of data.

In the above embodiment, all pieces of data included in the voice communication transferred to media processing device 40 are stored, but undesired sounds such as background noise may be eliminated before it is stored. In this case, media processing application 402 may have a noise filter that removes background noise contained in the speech data, and speech data storage device 403 may store speech data after the noise has been removed by the noise filter. According to this configuration, it is possible to store only the necessary pieces of data.

Preferably, not only background noises, but also silence data, may be eliminated before the data is stored.

In the above embodiment, data is duplicated at a relay device by sender IP address, and data is stored at a media processing device by sender IP address. However, another identifier may be used in duplicating data and storing data. For example, a MAC (Media Access Control) address in Ethernet™, a VCI (Virtual Channel Identifier) in ATM (Asynchronous Transfer Mode), or an IMSI (International Mobile Subscriber Identity) may be used. Furthermore, the communication terminal identifier of a communication terminal may be used. According to this modification, the communication system of the present embodiment can be provided in a network other than a network adopting IP (e.g. the Internet).

In the above embodiment, subscription information is used as the basis in determining whether to duplicate data at a relay device and to store the duplicated data at a media processing device. Instead, a caller communication terminal may transmit an instruction for recording speech data (i.e., duplication and storage of data) so that the only speech data that was indicated by the communication terminal is recorded at the media processing device. In this case, communication controller 203 of relay device 20 may cause data duplicator 202 to duplicate the speech data received from communication terminal 10 via data transmitter-receiver 201 in a case in which data transmitter-receiver 201 receives an instruction for the duplication from the communication terminal 10. According to this modification, speech data to be recorded can be freely indicated by a communication terminal.

Preferably, a user may be allowed to indicate whether to record the speech data after the voice communication is completed. In this case, speech synthesis DB engine 404 obtains the data file from speech data storage device 403, to create a database for speech synthesis, only in a case in which an instruction is given for adding the data file to the database.

In the above embodiment, the speech data of a communication terminal that subscribes to the speech synthesis service is stored at a media processing device, but the speech data of frequently contacting correspondents of a communication terminal that subscribes to the service may also be stored. Specifically, the speech data of the several most frequent correspondents may be stored so that, in a case in which a message is transmitted from one of the several most frequent correspondents, a speech-synthesized message is transmitted. In this case, even in a case in which communication terminal 10*a* subscribes to the speech synthesis service, but communication terminal 10*b* does not, communication controller 203 of relay device 20 to which communication terminal 10*a* is connected may cause data duplicator 202 to duplicate the speech data received from communication terminal 10*b* in a case in which the number of calls performed between the communication terminals in a certain period exceeds a threshold. According to this modification, even in a case in which a correspondent communication terminal does not subscribe to a speech synthesis service, a speech-synthesized message can be transmitted from the correspondent communication terminal.

In the above embodiment, the media processing device performs a speech synthesis process when a request message is transmitted, so as to automatically transmit the synthesized message. However, the speech-synthesized message may be checked at the caller communication terminal before transmitting the message to the correspondent. Specifically, the speech synthesized message may be reproduced at the caller communication terminal. According to this modification, a user of the caller communication terminal can confirm whether the synthesized message has a sufficient degree of individual speech characteristics to determine whether to transmit the message.

In the above embodiment, a media processing device stores speech data in different files, and furthermore, the stored files of speech data may be processed through speech recognition, and the recognized text and the files of speech data may be stored in association with each other.

In the foregoing, in a communication system for building a database for speech synthesis based on speech data during voice communication according to the present invention, the dialogues performed using a communication terminal are used to build the database for speech synthesis. Therefore, in this communication system, there is no need to have a user spend long periods of time for recoding or to have a dedicated studio for the recording. Therefore, according to the communication system for building a database for speech synthesis based on speech data during the voice communication according to the present invention, a database for speech synthesis can be readily built without having the user being aware that the recording is being performed for speech synthesis.

Moreover, a database for speech synthesis is built based on the dialogues held by a human subject who uses a communication terminal. Therefore, according to the present invention, it is possible to provide a speech synthesis database building method in which emphasis is placed on the individuality of reproducing speech characteristics of a human subject.

Furthermore, since no special texts are used for building the database, it is possible to provide synthesized data that is closer to the everyday conversation of a human subject.

In a case in which communication terminal 10 is a fixed terminal such as a personal computer, relay device 20 is a switching station of a fixed communication network. In this case, registration information DB 30 need not be provided because no location registration or connected point inquiry are required. In this case, relay device 20 itself may store profile information.

The invention claimed is:

1. A communication system comprising:

a relay device connected to a communication network;

at least two communication terminals connected to the communication network via the relay device, each communication terminal transmitting to, and receiving speech data from, another communication terminal via the relay device, wherein the at least two communication terminals includes a first communication terminal and a second communication terminal; and a media processing device connected to the relay device, the relay device comprising:

a transmitter-receiver that receives first speech data originating from the first communication terminal, and that transmits the received first speech data to the second communication terminal;

a data duplicator that duplicates speech data; and a communication controller that causes the data duplicator to duplicate the first speech data received from the first communication terminal via the transmitter-receiver and that causes the transmitter-receiver to transmit the duplicated speech data to the media processing device, and the media processing device comprising:

a receiver that receives, from the relay device, the duplicated speech data of the first communication terminal;

a speech data processor that stores speech data received by the receiver in a speech data storage device and that determines a piece of the duplicated speech data received by the receiver corresponds to a piece of stored speech data, wherein the speech data processor is configured to overwrite the stored piece of speech data with the received piece of the duplicated speech data based on an acoustic quality of the received piece of the duplicated speech data exceeding an acoustic quality of the stored piece of speech data;

a speech synthesis database generator that generates a speech synthesis database for the first communication terminal based on the speech data stored in the speech data storage device;

a speech synthesis database storage device that stores the speech synthesis database generated by the speech synthesis database generator; and a speech synthesizer that executes speech synthesis based on the speech synthesis database in a case in which a request is received from the first communication terminal.

2. A communication system according to claim 1, wherein the relay device further comprises a communication information storage device that stores communication information on the first and the second communication terminals, the communication information at least including service information indicating whether the first communication terminal subscribes to a speech synthesis service, and wherein the communication controller is configured to determine that the speech data received by the transmitter-receiver is to be duplicated in a case in which the service information indicates that the first communication terminal subscribes to the speech synthesis service and the communication controller is further configured to cause the data duplicator to duplicate the speech data.

3. A communication system according to claim 2, further comprising a subscription information database device that is connected to the relay device and that stores subscription information on each of the at least two communication terminals, wherein the communication information on the first communication terminal stored in the communication information storage device is created based on information downloaded from the subscription information database device.

4. A communication system according to claim 2, wherein the transmitter-receiver of the relay device is configured to receive second speech data from the second communication terminal and transmit the received second speech data to the first communication terminal, and wherein the communication controller is configured to cause the data duplicator to duplicate the second speech data received from the second communication terminal via the transmitter-receiver in a case in which a number of calls performed between the first and the second communication terminals in a certain period exceeds a threshold.

5. A communication system according to claim 1, wherein the communication controller is configured to cause the data duplicator to duplicate the first speech data received from the first communication terminal via the transmitter-receiver in a case in which the transmitter-receiver receives a duplication instruction from the first communication terminal.

6. A communication system according to claim 1, wherein the speech data processor further comprises a noise filter that removes background noise contained in the speech data, and wherein the speech data processor is configured to store the speech data after the background noise has been removed by the noise filter.

7. A communication system according to claim 1, wherein the transmitter-receiver of the relay device is further configured to receive second speech data originating from the second communication terminal and transmit the received second speech data to the first communication terminal; wherein the communication controller is configured to cause the data duplicator to duplicate at least one of a first piece of speech data included in the received first speech data or a second piece of speech data included in the received second speech data and to cause the transmitter-receiver to transmit, to the media processing device, the duplicated at least one of the first piece of speech data or the second piece of speech data together with identification information identifying at least one of the first or the second communication terminals as an originating communication terminal, and wherein the receiver of the media processing device is configured to receive, from the relay device, the duplicated at least one of the first piece of speech data or the second piece of speech data and the identification information; wherein the speech data processor is configured to store in the speech data storage device the at least one of the first piece of speech data or the second piece of speech data received by the receiver along with the identification information; wherein the speech synthesis database generator is configured to generate the speech synthesis database for the originating communication terminal based on the speech data stored in the speech data storage device; and wherein the speech synthesizer is configured to execute speech synthesis based on the speech synthesis database in a case in which a request for speech synthesis is received from the originating communication terminal identified by the identification information as at least one of the first or the second communication terminals.

8. A communication system according to claim 7, wherein the relay device further comprises a communication information storage device that stores communication information on the first and the second communication terminals, the communication information at least including service information for each of the first and second communication terminals, the service information indicating whether each of the first and second communication terminals subscribes to a speech synthesis service, and wherein the communication controller is further configured to determine that the first speech data received by the transmitter-receiver is to be duplicated in a case in which the service information indicates that the first communication terminal subscribes to the speech synthesis service and the communication controller is further configured to cause the data duplicator to duplicate the first speech data and to determine that the second speech data received by the transmitter-receiver is to be duplicated in a case in which the service information indicates that the second communication terminal subscribes to the speech synthesis service and the communication controller is further configured to cause the data duplicator to duplicate the second speech data.

9. A communication system according to claim 8, further comprising a subscription information database device that is connected to the relay device, the subscription information database device configured to store subscription information on each of the at least two terminals, wherein the relay device further comprises a first downloader that downloads, from the subscription information database device, service information on the first communication terminal, for storage in the communication information storage device, and a second downloader that downloads, from the subscription information database device, service information on the second communication terminal, for storage in the communication information storage device.

10. A communication system according to claim 9, wherein the communication system comprises a plurality of the relay devices, including a first relay device connected to the first communication terminal and including the first downloader, and a second relay device connected to the second communication terminal and including the second downloader; wherein the second relay device further comprises a transferer that transfers the service information on the second communication terminal to the first relay device, and wherein the first relay device is configured to store the service information on the first communication terminal downloaded by the first downloader and the service information on the second communication terminal transmitted from the second relay device in the communication information storage device.

11. A communication system comprising:

a relay device connected to a communication network;

at least two communication terminals connected to the communication network via the relay device, each communication terminal transmitting to, and receiving speech data from, another communication terminal via the relay device, wherein the at least two communication terminals includes a first communication terminal and a second communication terminal; and a media processing device connected to the relay device, the relay device comprising:

a transmitter-receiver that receives first speech data originating from the first communication terminal and that transmits the received first speech data to the second communication terminal;

a data duplicator that duplicates speech data; and a communication controller that causes the data duplicator to duplicate the first speech data received from the first communication terminal via the transmitter-receiver and that causes the transmitter-receiver to transmit the duplicated speech data to the media processing device, and the media processing device comprising:

a receiver that receives, from the relay device, the duplicated speech data of the first communication terminal;

a speech data processor that stores speech data received by the receiver in a speech data storage device, wherein the speech data processor further comprises a determiner that determines whether a piece of speech data received by the receiver corresponds to any piece of the stored speech data, and a noise measurer that measures the amount of noise contained in the received piece of speech data and the amount of noise contained in a corresponding piece of stored speech data, and wherein the speech data processor is configured to overwrite the corresponding piece of stored speech data with the received piece of speech data in a case in which an amount of noise of the received piece of speech data is less than that of the corresponding piece of stored speech data;

a speech synthesis database generator that generates a speech synthesis database for the first communication terminal based on the speech data stored in the speech data storage device;

a speech synthesis database storage device that stores the speech synthesis database generated by the speech synthesis database generator; and a speech synthesizer that executes speech synthesis based on the speech synthesis database in a case in which a request for speech synthesis is received from the first communication terminal.

12. A relay device for use in a communication system with a first communication terminal and a second communication terminal connected to the communication system via the relay device, the relay device comprising:

a transmitter-receiver that receives speech data from the first communication terminal and transmits the received speech data to the second communication terminal;

a data duplicator that duplicates speech data; and a communication controller that causes the data duplicator to duplicate the speech data received from the first communication terminal via the transmitter-receiver and that causes the transmitter-receiver to transmit the duplicated speech data together with identification information identifying one of the first or the second communication terminals as an originating communication terminal to a media processing device, the media processing device for storage of the duplicated speech data, and generation of a speech synthesis database, the media processing device including a speech data processor configured to measure a first acoustic quality associated with the duplicated speech data, and measure a second acoustic quality associated with a piece of previously stored speech data to determine whether the piece of previously stored speech data corresponds to the duplicated speech data.

13. A relay method for use at a relay device in a communication system with a first communication terminal and a second communication terminal connected to the communication system via the relay device, the method comprising:

receiving speech data from the first communication terminal and transmitting the received speech data to the second communication terminal;

duplicating the speech data received in the receiving step; and transmitting the duplicated speech data together with identification information identifying one of the first or the second communication terminals as an originating communication terminal to a media processing device, the media processing device storing the duplicated speech data and generating a speech synthesis database, the media processing device including a speech data processor configured to measure a first acoustic quality associated with the duplicated speech data, and measure a second acoustic quality associated with a piece of previously stored speech data to determine whether the piece of previously stored speech data corresponds to the duplicated speech data.

14. A media processing device comprising:

a receiver configured to receive speech data from a relay device;

a speech data processor configured to store the received speech data in a speech data storage device, wherein the speech data processor is further configured to determine whether a piece of the received speech data corresponds to a piece of previously stored speech data included in the speech data storage device by measurement of a first acoustic quality associated with the piece of received speech data, and measurement of a second acoustic quality associated with the piece of previously stored speech data;

a speech synthesis database generator that generates a speech synthesis database based on speech data stored in the speech data storage device; and a speech synthesis database storage device configured to store the speech synthesis database generated by the speech synthesis database generator.

15. The media processing device of claim 14, wherein the speech data processor is further configured to overwrite the corresponding piece of previously stored speech data with the piece of received speech data based on the first acoustic quality exceeding the second acoustic quality.

16. The media processing device of claim 14, wherein the speech data processor further comprises a noise filter that removes background noise contained in the received speech data, and wherein the speech data processor is further configured to store the speech data after the noise has been removed by the noise filter.

17. A media processing device comprising:

a receiver configured to receive speech data from a relay device;

a speech data processor configured to store the received speech data in a speech data storage device, wherein the speech data processor is further configured to determine whether a piece of the received speech data corresponds to a piece of previously stored speech data included in the speech data storage device;

a speech synthesis database generator that generates a speech synthesis database based on speech data stored in the speech data storage device; and a speech synthesis database storage device configured to store the speech synthesis database generated by the speech synthesis database generator, wherein the speech data processor is further configured to determine a first amount of noise contained in the piece of received speech data and a second amount of noise contained in the piece of previously stored speech data that corresponds.

18. The media processing device of claim 17, wherein the speech data processor is further configured to overwrite the corresponding piece of previously stored speech data with the piece of received speech data based on the first amount of noise being less than the second amount of noise.

19. The media processing device of claim 17, wherein the speech data processor further comprises a noise filter that removes background noise contained in the received speech data, and wherein the speech data processor is further configured to store the speech data after the noise has been removed by the noise filter.

20. A communication system comprising:

a relay device connected to a communication network;

at least two communication terminals connected to the communication network via the relay device, each communication terminal configured to transmit to, and receive speech data from, another communication terminal via the relay device, wherein the at least two communication terminals includes a first communication terminal and a second communication terminal; and a media processing device connected to the relay device, the relay device comprising:

a transmitter-receiver configured to receive first speech data originating from the first communication terminal and second speech data originating from the second communication terminal, the transmitter-receiver further configured to transmit the received first speech data to the second communication terminal, and transmit the received second speech data to the first communication terminal;

a data duplicator configured to duplicate speech data; and a communication controller configured to cause the data duplicator to duplicate at least one of a first piece of speech data included in the received first speech data or a second piece of speech data included in the received second speech data, and to cause the transmitter-receiver to transmit, to the media processing device, the duplicated at least one of the first piece of speech data or the second piece of speech data together with identification information identifying at least one of the first or the second communication terminals as an originating communication terminal, and the media processing device comprising:

a receiver configured to receive, from the relay device, the duplicated at least one of the first piece of speech data or the second piece of speech data and the identification information;

a speech data processor configured to receive and store in a speech data storage device the at least one of the first piece of speech data or the second piece of speech data received by the receiver along with the identification information, the speech data processor further configured to measure a first acoustic quality associated with the at least one of the first piece of speech data or the second piece of speech data, and measure a second acoustic quality associated with a piece of previously stored speech data to determine whether the at least one of the first piece of speech data or the second piece of speech data corresponds to the piece of previously stored speech data;

a speech synthesis database generator configured generate a speech synthesis database for the originating communication terminal based on the speech data stored in the speech data storage device;

a speech synthesis database storage device configured to store the speech synthesis database generated by the speech synthesis database generator; and a speech synthesizer configured to execute speech synthesis using the speech synthesis database, the speech synthesis executed by the speech synthesizer in response to receipt of a request for speech synthesis received from the originating communication terminal identified by the identification information as at least one of the first or the second communication terminals.

21. A relay device for use in a communication system with a first communication terminal and a second communication terminal connected to the communication system via the relay device, the relay device comprising:

a transmitter-receiver that receives speech data from the first communication terminal and transmits the received speech data to the second communication terminal;

a data duplicator that duplicates speech data; and a communication controller that causes the data duplicator to duplicate the speech data received from the first communication terminal via the transmitter-receiver and that causes the transmitter-receiver to transmit the duplicated speech data together with identification information identifying one of the first or the second communication terminals as an originating communication terminal to a media processing device, the media processing device for storage of the duplicated speech data, and generation of a speech synthesis database, the media processing device including a speech data processor configured to determine a first amount of noise contained in the duplicated speech data, and a second amount of noise contained in a piece of previously stored speech data that corresponds to the duplicated speech data.

22. A relay method for use at a relay device in a communication system with a first communication terminal and a second communication terminal connected to the communication system via the relay device, the method comprising:

receiving speech data from the first communication terminal and transmitting the received speech data to the second communication terminal;

duplicating the speech data received in the receiving step;

transmitting the duplicated speech data together with identification information identifying one of the first or the second communication terminals as an originating communication terminal to a media processing device; and the media processing device storing the duplicated speech data, generating a speech synthesis database, and determining a first amount of noise contained in the duplicated speech data and a second amount of noise contained in a piece of previously stored speech data that corresponds to the duplicated speech data.

23. A communication system comprising:

a relay device connected to a communication network;

at least two communication terminals connected to the communication network via the relay device, each communication terminal configured to transmit to, and receive speech data from, another communication terminal via the relay device, wherein the at least two communication terminals includes a first communication terminal and a second communication terminal; and a media processing device connected to the relay device, the relay device comprising:

a transmitter-receiver configured to receive first speech data originating from the first communication terminal and second speech data originating from the second communication terminal, the transmitter-receiver further configured to transmit the received first speech data to the second communication terminal, and transmit the received second speech data to the first communication terminal;

a data duplicator configured to duplicate speech data; and a communication controller configured to cause the data duplicator to duplicate at least one of a first piece of speech data included in the received first speech data or a second piece of speech data included in the received second speech data, and to cause the transmitter-receiver to transmit, to the media processing device, the duplicated at least one of the first piece of speech data or the second piece of speech data together with identification information identifying at least one of the first or the second communication terminals as an originating communication terminal, and the media processing device comprising:

a receiver configured to receive, from the relay device, the duplicated at least one of the first piece of speech data or the second piece of speech data and the identification information;

a speech data processor configured to receive and store in a speech data storage device the at least one of the first piece of speech data or the second piece of speech data received by the receiver along with the identification information, the speech data processor further configured to determine a first amount of noise contained in the at least one of the first piece of speech data or the second piece of speech data, and a second amount of noise contained in a piece of previously stored speech data that corresponds to the at least one of the first piece of speech data or the second piece of speech data;

a speech synthesis database generator configured generate a speech synthesis database for the originating communication terminal based on the speech data stored in the speech data storage device;

a speech synthesis database storage device configured to store the speech synthesis database generated by the speech synthesis database generator; and a speech synthesizer configured to execute speech synthesis using the speech synthesis database, the speech synthesis executed by the speech synthesizer in response to receipt of a request for speech synthesis received from the originating communication terminal identified by the identification information as at least one of the first or the second communication terminals.

* * * * *

UNITED STATES PATENT AND TRADEMARK OFFICE

CERTIFICATE OF CORRECTION

PATENT NO. : 8,265,927 B2
APPLICATION NO. : 12/389062
DATED : September 11, 2012
INVENTOR(S) : Shin-ichi Isobe et al.

It is certified that error appears in the above-identified patent and that said Letters Patent is hereby corrected as shown below:

In the Specification

In column 26, line 40, insert -- to -- before "generate".

In column 28, line 31, insert -- to -- before "generate".

Signed and Sealed this
Second Day of April, 2013

Teresa Stanek Rea
*Acting Director of the United States Patent and Trademark Office*